US009815598B2

(12) United States Patent
Cutts et al.

(10) Patent No.: US 9,815,598 B2
(45) Date of Patent: Nov. 14, 2017

(54) CONTAINER

(71) Applicant: Mars, Incorporated, McLean, VA (US)

(72) Inventors: Matthew Cutts, Sydney (AU); Michael Ford, Sydney (AU); Lynne Morrison, Sydney (AU); James Brennan, Sydney (AU); Stuart May, Sydney (AU); Matthew Cormack, Sydney (AU)

(73) Assignee: Mars, Incorporated, McLean, VA (US)

( * ) Notice: Subject to any disclaimer, the term of this patent is extended or adjusted under 35 U.S.C. 154(b) by 0 days.

(21) Appl. No.: 15/007,623

(22) PCT Filed: Jan. 8, 2014

(86) PCT No.: PCT/AU2014/000770
§ 371 (c)(1),
(2) Date: Jan. 27, 2016

(87) PCT Pub. No.: WO2015/089544
PCT Pub. Date: Jun. 25, 2015

(65) Prior Publication Data

US 2016/0214770 A1 Jul. 28, 2016

(30) Foreign Application Priority Data

Aug. 1, 2013 (AU) ..... 2013902858

(51) Int. Cl.
*B67B 1/00* (2006.01)
*B65D 47/12* (2006.01)
(Continued)

(52) U.S. Cl.
CPC ..... *B65D 47/12* (2013.01); *B65D 35/44* (2013.01); *B65D 41/04* (2013.01); *B65D 41/465* (2013.01);
(Continued)

(58) Field of Classification Search
CPC ..... B65D 47/12; B65D 47/243; B65D 35/44; B65D 41/04; B65D 41/465; B65D 55/06;
(Continued)

(56) References Cited

U.S. PATENT DOCUMENTS 3,179,276 A 4/1965 Safianoff
4,690,304 A * 9/1987 Morel ..... B65D 47/24 222/520
(Continued)

FOREIGN PATENT DOCUMENTS

CN 1232771 A 10/1999
CN 1288441 A 3/2001
(Continued)

OTHER PUBLICATIONS

Supplemental Partial European Search Report from European Patent Application No. 14873111 dated Jan. 2, 2017.

*Primary Examiner* — Benjamin R Shaw
(74) *Attorney, Agent, or Firm* — Greenberg Traurig

(57) ABSTRACT

A container (10) to dispense a liquid such as sauce. The container (1.0) has a resilient deformable body (11) that may be compressed to dispense the liquid from the interior (55) of the body (11). Mounted on the body (11) is a cap (37) that is movable along a path (axis 13) between a closed position and an open position. In the open position the upper opening (38) is open to allow the liquid to be dispensed. Preferably the path is linear.

12 Claims, 24 Drawing Sheets

(51) Int. Cl.
*B65D 41/46* (2006.01)
*B65D 47/24* (2006.01)
*B65D 35/44* (2006.01)
*B65D 41/04* (2006.01)
*B65D 55/06* (2006.01)

(52) U.S. Cl.
CPC ..... *B65D 47/243* (2013.01); *B65D 55/06* (2013.01); *B65D 2101/0023* (2013.01)

(58) Field of Classification Search
CPC ..... B65D 2101/0023; B65D 55/024; B65D 55/02; B65D 55/08; B65D 41/32; B65D 51/18; B65D 2251/0018; B65D 2251/0046; B65D 2251/0056; B65D 2251/0078; B65D 2251/0087; B65D 1/0238
USPC ..... 222/153.05, 153.06
See application file for complete search history.

(56) References Cited

U.S. PATENT DOCUMENTS 4,805,807 A * 2/1989 Perne ..... B65D 47/242 215/256
5,104,008 A * 4/1992 Crisci ..... B65D 47/243 215/253
5,358,151 A 10/1994 Strasenburgh
5,429,282 A * 7/1995 Stebick ..... B65D 47/243 222/520
5,456,374 A * 10/1995 Beck ..... B65D 41/3447 215/251
5,465,876 A * 11/1995 Crisci ..... B65D 47/243 215/253
5,588,562 A * 12/1996 Sander ..... B65D 41/3447 215/252
5,655,685 A * 8/1997 Carr ..... B65D 41/3428 222/153.02
5,662,247 A * 9/1997 Rapchak ..... B65D 41/48 222/153.07
5,680,965 A * 10/1997 Beck ..... B65D 47/243 222/153.06
5,699,924 A * 12/1997 Mascio ..... B65D 41/3447 215/252
5,829,611 A * 11/1998 Beck ..... B65D 47/127 215/252
5,862,953 A * 1/1999 Long, Jr. ..... B65D 41/3447 222/153.06
6,095,375 A * 8/2000 Adams ..... B65D 41/17 222/182
6,257,463 B1 * 7/2001 De Polo ..... B65D 47/243 222/525
2003/0173380 A1 9/2003 Gerber et al.
2006/0208003 A1 9/2006 Ophardt et al.
2007/0269560 A1 11/2007 Scott et al.
2008/0023502 A1 * 1/2008 Knes ..... B65D 47/243 222/524
2010/0213211 A1 8/2010 Whaling et al.
2014/0048537 A1 * 2/2014 McPherson ..... B65D 49/04 220/276

FOREIGN PATENT DOCUMENTS

CN 2797237 Y 3/2001
DE 203 19 035 U1 3/2004
WO 98/21110 A2 5/1998
WO 2003/026999 A1 4/2003

* cited by examiner 10
11
15
37
41
44
70
71
72
73
29
38

38
13

49
51
50
51
47
10
20
23
56
41
30
22
18
117
15
17
16
33
31
116
11
14
55

CONTAINER

FIELD

The present invention relates to containers that dispense a liquid, and more particularly but not exclusively to containers that dispense liquids such as sauces and mayonnaise.

BACKGROUND

It is not uncommon for sauces and mayonnaise to be dispensed via a container that is squeezed to provide for the flow of liquid through a nozzle opening in the container. Typically the nozzle would be closed by means of a cap that is moved angularly about the nozzle between a first position closing the nozzle, and an open position permitting the flow of liquid out of the nozzle.

Containers as discussed above suffer from a number of disadvantages including not providing an indication whether the container has been tampered with. A further disadvantage is that the container needs to be operated by two hands. That is when moving the cap to the open position, a user grips the container body with one hand and moves the cap angularly between the open and closed positions with the other hand.

Containers having nozzles are also used to dispense liquids such as fruit juices and sports drinks. In such instances the nozzle is closed by a small closure member mounted on the end of the nozzle. These types of containers require both hands to move the closure member to the open position. It is also not uncommon for a user to employ their teeth to move the closure member between the closed position and open position. A disadvantage of these containers is that they require two hands to be operated easily, while it is most undesirable for a user to employ their teeth.

Other containers used to dispense sauce (ketchup) frequently have a cap that is merely thread engaged with the neck of a bottle or body of a container. Other caps are pivotally attached to the body by means of a threaded base, with a closure member pivotally attached to the base and snap engage with the base to close the dispensing aperture in the base.

A disadvantage of the above containers is that frequently they are provided with a seal that closes the opening in the body, that is the opening between the cap (closure assembly) and the body. When purchasing a container such as the above, it is not readily apparent whether this seal has been tampered with. Essentially the cap (closure assembly) needs to be removed and the seal inspected.

OBJECT

It is the object of the present invention to overcome or substantially ameliorate at least one of the above disadvantages.

SUMMARY

There is disclosed herein a container from which a liquid can be dispensed, the container including:

a hollow body having an interior to receive the liquid, and a tip surrounding a body opening via which the liquid can leave said interior;

a closure assembly attached to the body to close said opening, said assembly including:

a member including a base attached to the body adjacent said lip, a passage extending through the member and being in communication with said interior to provide for the dispensing of said liquid from said interior via said passage:

a cap having a cap end opening via which the liquid is dispensed, said opening communicating with the said passage, said cap being mounted on the member for movement relative thereto between a first position at which the member closes said cap opening and a second position allowing the flow of liquid from within the passage to exit via said cap opening; and a tamper indicator that, when the closure assembly is attached to the body, provides a visual indication in respect of whether the base has been moved relative to the body thereby providing an indication in respect of whether the interior has been exposed, and a visual indication in respect of whether said cap has been moved from the first position exposing said passage.

Preferably, said member is a nozzle member, with the nozzle member including a nozzle extending from the base and through which the passage also extends, with the nozzle cooperating with the cap to open and close the cap end opening.

Preferably, the base threadably engages the lip to secure the base and therefore closure assembly to the body, and the cap engages the member so as to be restrained to move along a generally linear path between the first and second positions of the cap.

Preferably, the tamper indicator includes a tamper indicator portion that extends between the cap and the body and that is ruptured should the closure assembly be moved relative to the body or the cap moved relative to the member.

Preferably, said body has a body base upon which the body rests so that the body extends generally upwardly therefrom, with the closer assembly having a longitudinal axis along which the cap moves between the first and second positions thereof.

Preferably, the longitudinal axis is generally perpendicular to the body base.

In an alternative preferred form the longitudinal axis is inclined to the body base by an acute angle.

Preferably, the tamper indicator includes a first indicator portion indicating whether the base has been moved, relative to the body, and a second indicator portion indicating whether the cap has been moved relative to the base.

Preferably, the first indicator portion includes bridges or webs that are fractured to indicate tampering, and said indicator includes a handle gripped by a user to remove the indicator.

Preferably, the second indicator portion includes webs or bridges that are fractured to indicate tampering, with the indicator including an indicator part attached to the cap with the second indicator portion attaching the indicator part to the handle.

Preferably, the closure assembly and body have cooperating surfaces that engage to at least inhibit movement of the closure assembly to remove the closure assembly from the body.

Preferably, the cooperating surfaces are provided by a cooperating abutment and pawl.

There is further disclosed herein a container to dispense a liquid, the container including:

a body having an interior to receive the liquid, a lip surrounding a body opening via which liquid leaves the interior, a peripheral surface to be gripped in a user's palm so that a user can hold the container, and a shoulder extending inwardly from said peripheral surface toward said lip;

a closure assembly attached to the body to close said opening, the assembly including a member having a base attached to the body adjacent said lip, a passage extending through the member and communicating with said interior to provide for the dispensing of said liquid via said passage;

a cap having an end cap opening and mounted on the member, the cap being movable relative to the member between a first position at which the member closes said cap opening and a second position allowing liquid to flow from said passage to be dispensed via said cap opening, with said cap in said first position being located adjacent said shoulder, while in said second position being spaced from said shoulder; and wherein said cap projects relative to said shoulder, when in its first position, so that a user gripping the body can apply finger pressure via a finger of said palm to said cap to move the cap to the second position, with movement between the first and second positions being along a generally linear path.

Preferably, the cap and member have cooperating guide surfaces that restrain the cap to move relative to the base along the generally linear path between the first and second positions thereof.

Preferably, the cap has an abutment surface against which the user applies finger pressure to move the cap from the first and second positions.

Preferably, the cap has a flange that projects beyond the peripheral surface adjacent said shoulder to provide for a user to apply finger pressure via the flange to the cap to move the cap from the first and second positions.

Preferably, said body has a body base upon which the body rests so that the body extends generally upwardly therefrom, with the closer assembly having a longitudinal axis along which the cap moves between the first and second positions thereof.

Preferably, the longitudinal axis is generally perpendicular to the body base.

In an alternative preferred form the longitudinal axis is inclined to the body base by an acute angle.

There is further disclosed herein a container to dispense liquid, the container including:

a body having an interior to receive the liquid, a lip surrounding a body opening via which liquid leaves the interior, a peripheral surface to be gripped in a user's palm so that a user can hold the container, and a shoulder extending inwardly from said peripheral surface towards said lip, so that the body opening is surrounded by the shoulder;

a closure assembly attached to the body to close said body opening, the assembly including:

a member having a base attached to the body adjacent the lip, and a passage extending through the member and communicating with said interior to provide for the dispensing of liquid via said passage;

a cap having an end cap opening and mounted on the member, the cap being movable relative to the member between a first position at which the member closes said cap opening and a second position allowing liquid to flow from said passage to be dispensed via said cap opening, with said cap in said first position being located adjacent said shoulder, while in said second position being spaced from said shoulder; and wherein said peripheral surface tapers to said shoulder and includes edge surfaces extending upwardly from said base to said shoulder, a major front surface extending upwardly from said base to said shoulder, and a major rear surface extending upwardly from said base to said shoulder, and said nozzle member has a longitudinal axis inclined to said base by an acute angle.

Preferably, the member is a nozzle member with the nozzle member including a nozzle cooperating with the cap opening to open and close the cap opening, with said passage extending through said base and nozzle, with said passage extending generally parallel to said axis.

Preferably, said cap moves along a generally linear path between the first and second positions thereof, with said path being parallel to said axis.

Preferably, said shoulder is inclined to said base with said shoulder generally perpendicular to said axis.

BRIEF DESCRIPTION OF DRAWINGS

Preferred forms of the present invention will now be described by way of example with reference to the accompanying drawings.

DESCRIPTION OF EMBODIMENTS

Figure 1:
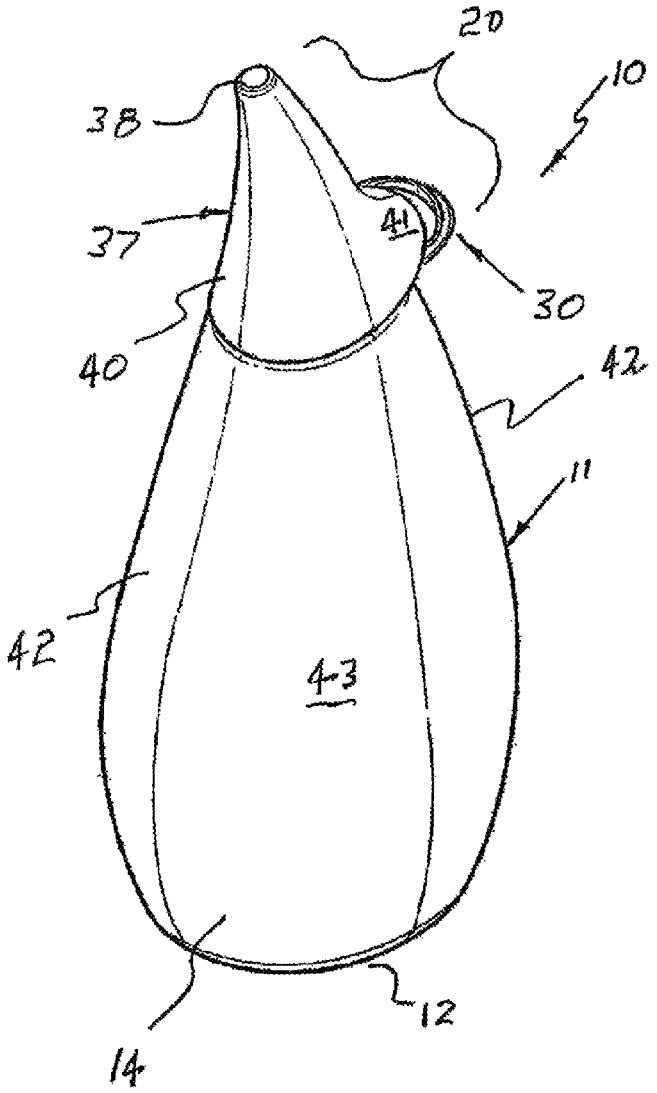
FIG. 1 is a schematic isometric view of a container to dispense a liquid such as sauce or mayonnaise.
Figure 2:
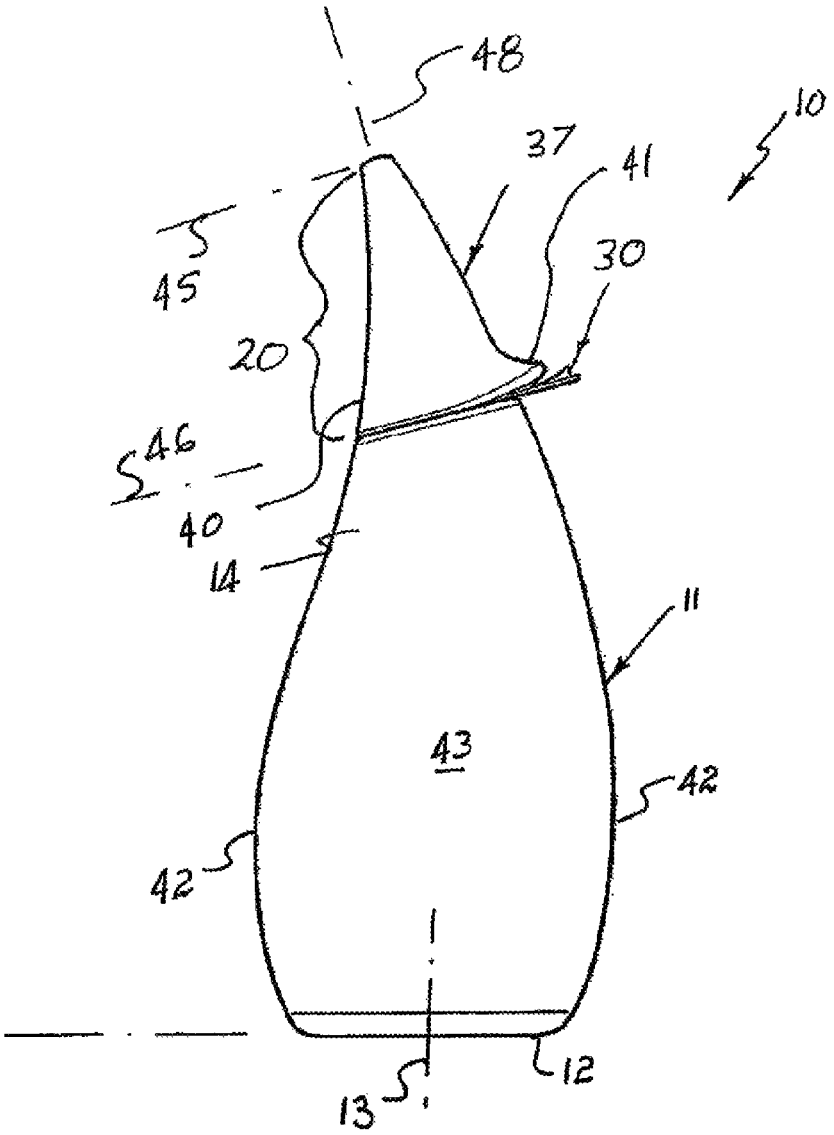
FIG. 2 is a schematic side elevation of a container of FIG. 1.
Figure 3:
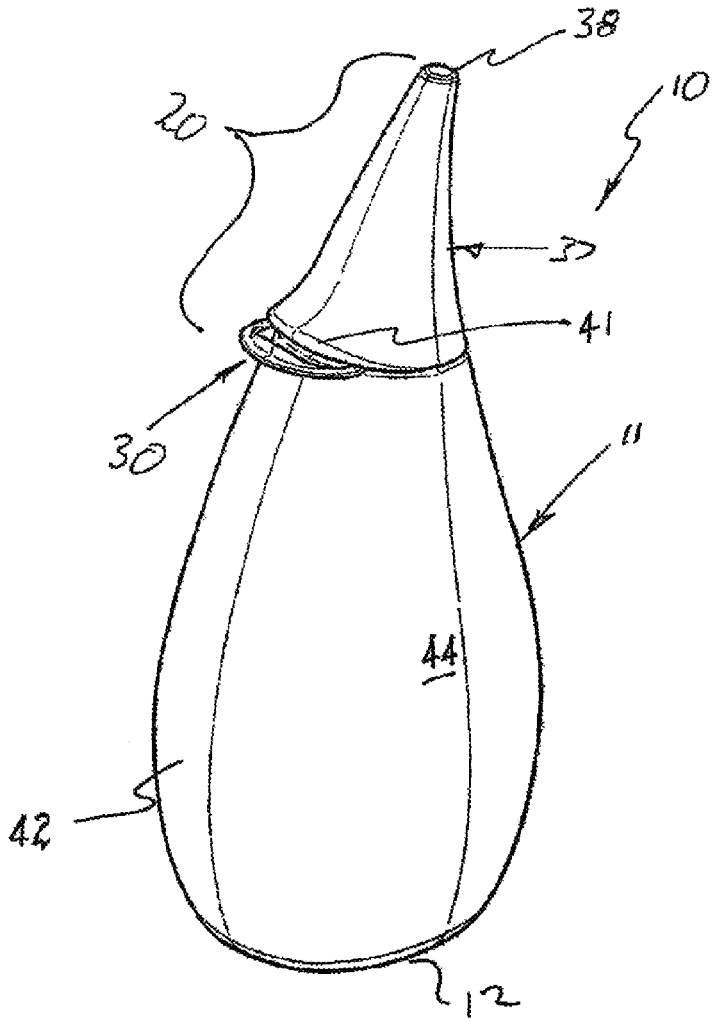
FIG. 3 is a schematic rear isometric view of the container of FIG. 1.
Figure 4:
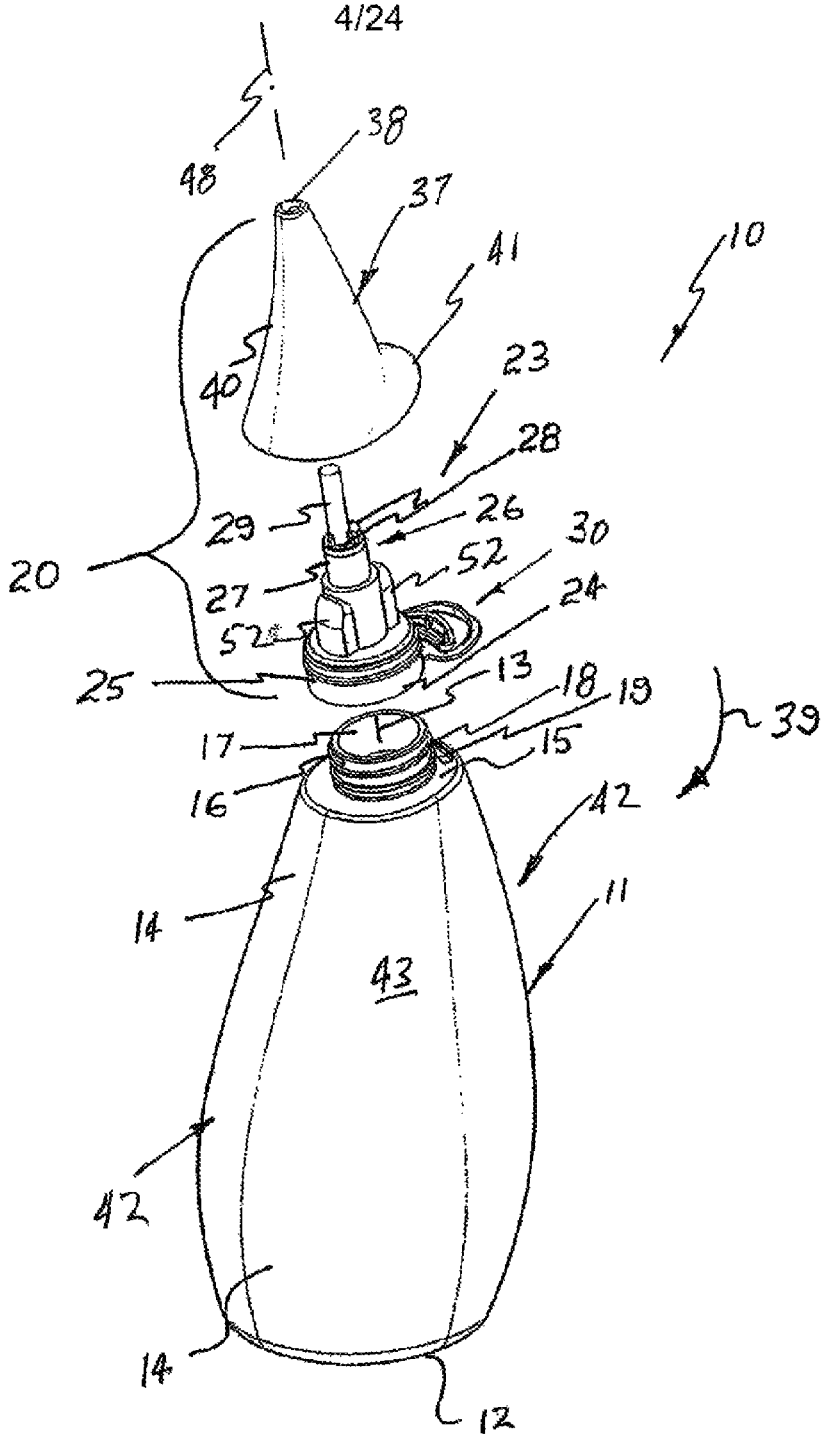
FIG. 4 is a schematic parts exploded isometric view of the container of FIG. 1.
Figure 5:
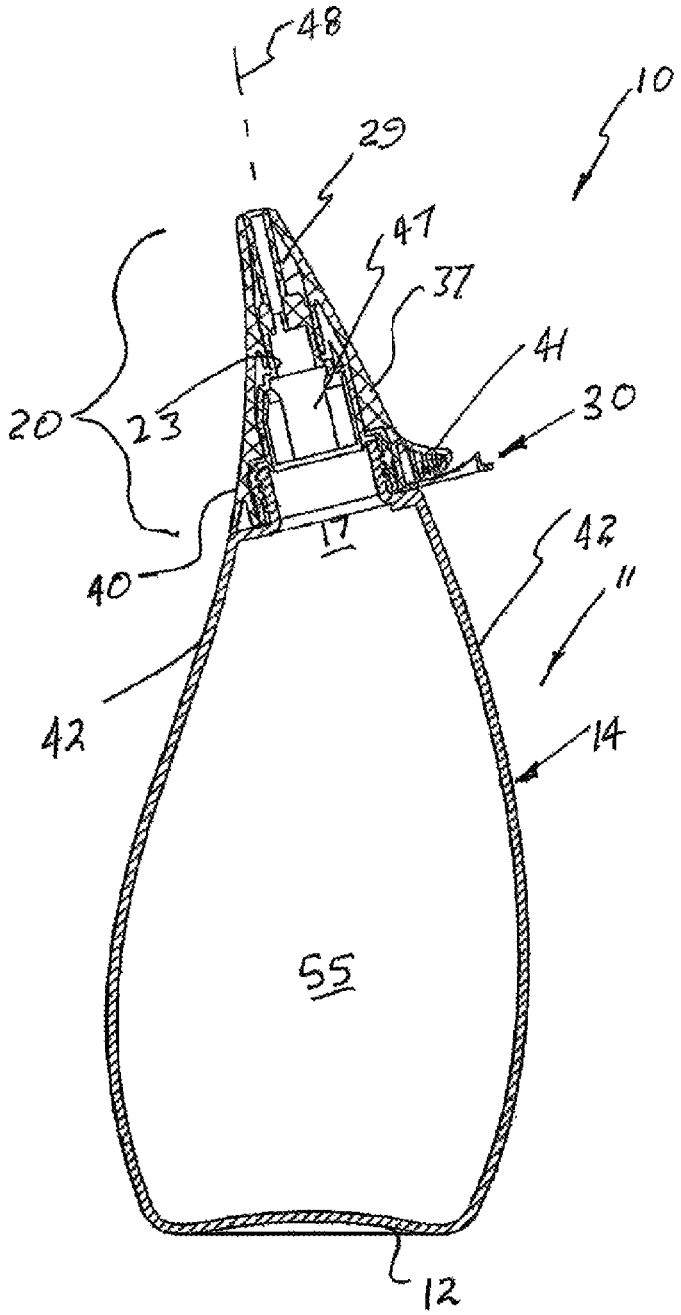
FIG. 5 is a schematic section side elevation of the container of FIG. 1.
Figure 6:
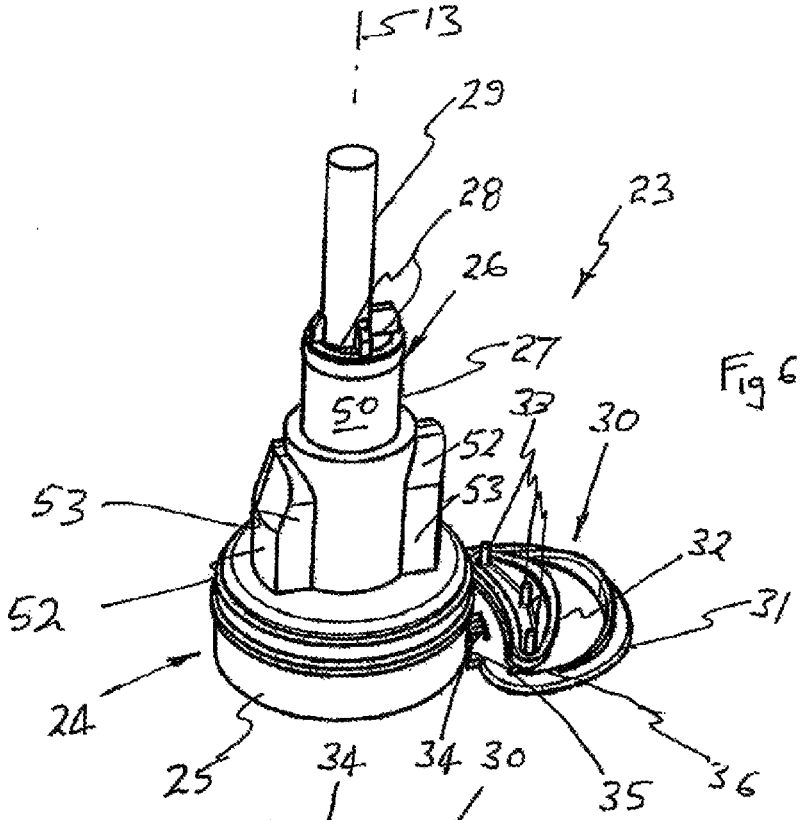
FIG. 6 is a schematic top isometric view of a nozzle of the container of FIG. 1.
Figure 7:
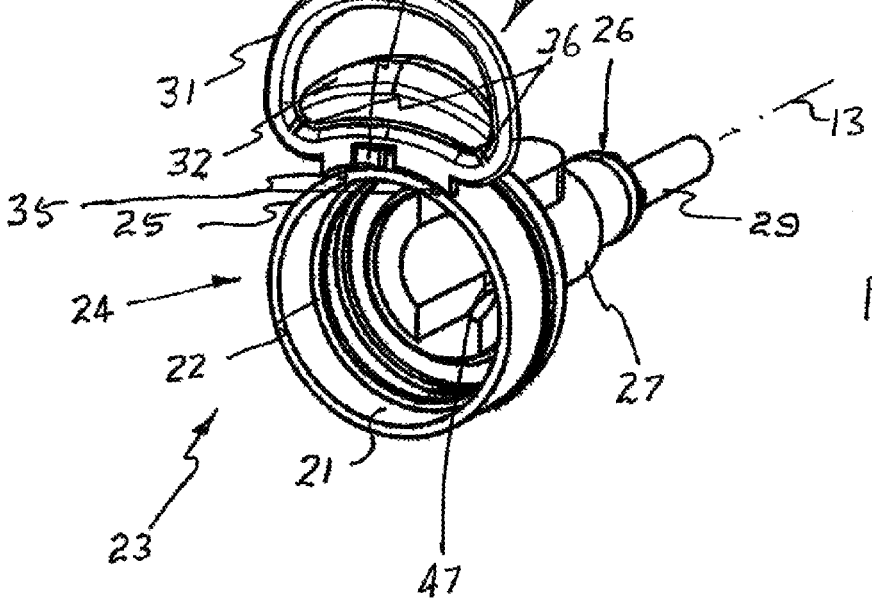
FIG. 7 is a bottom isometric view of the nozzle of FIG. 6.

In the FIGS. 1 to 9 of accompanying drawings there is schematically depicted a container 10. Typically the container 10 would be formed of plastics material and particularly adapted to dispense a liquid, such as sauce or mayonnaise. Typically the container 10 would include a hollow body 11, enclosing an interior 55, with the body 11 being elastically deformable so that a user gripping the body 11 can squeeze the body 11 to cause the liquid to flow from within the interior of the body 11 to be dispensed.

The body 11 has a base 12 that enables the container 10 to be supported on a generally horizontal surface with the container 10 upwardly extending. The body 11 has a generally central longitudinally axis 13, side edge portions 42, a major front face 43 and a major rear surface 44. The front face 43 and/or rear face 44 are arranged to receive a label, or labels, or printing. Preferably, the front face 43 and rear face 44 are generally flat or are slightly curved. If curved and when viewed in plan, the radius of the faces 43 and 44 is reasonably large relative to the radius of the curved edge portions 42. That is, the edge portions 42 would have a radius substantially less than the radius of the front face 43 and rear face 44.

The peripheral surface 14 at its upper portion has a shoulder 15 that extends inwardly towards the axis 13 to a lip (neck) 16 surrounding an opening 17 via which liquid within the interior of the body 11 is allowed to flow. The opening 17 is closed by means of a closure assembly 20. The lip 16 and opening 17 are spaced from the surface 14 by the shoulder 15, so that the opening 17 is surrounded by the shoulder 15.

The peripheral surface 14 tapers to the shoulder 15. One edge portion 42 is convex as it extends to the shoulder 15, while the other edge portion 42, adjacent the shoulder 15, is concave.

The lip 16 is generally cylindrical and includes a thread 18.

The shoulder 15 is also provided with a recess 19.

The closure assembly 20 includes a nozzle member 23 that is integrally formed of plastics material and includes a base 24 having an internal cylindrical surface 21 with a thread 22. In particular the base 24 has an annular flange 25 providing the surface 21.

The nozzle member 23 includes a nozzle 26 extending from the base 24. The nozzle 26 includes a hollow stem 27 providing, a longitudinal passage 47 extending to a plurality of openings 28. The openings 28 and passage 47 provide for the flow of liquid from the interior 55 to be dispensed from the upper end of the container 10. The nozzle 26 includes a projection 29 fixed to and extending from the stem 27. Preferably the projection 29 is a cylindrical projection.

The passage 47 extends away from the shoulder 15 at a position spaced from the surface 14, and preferably centrally of the shoulder 15.

Formed integrally with the base 24 is a tamper indicator 30. The indicator 30 includes a handle 31 that has attached to it an indicator part 32 with clip parts 33, and a pawl 34 that is locatable in the recess 19.

The indicator 30 is attached to the flange 25 (and therefore the base 24) by means of frangible portions (first indicator portion) in the form of webs 35.

The indicator part 32 is attached to the handle 11 by frangible portions (second indicator portion) in the form of webs 36.

Figure 9:
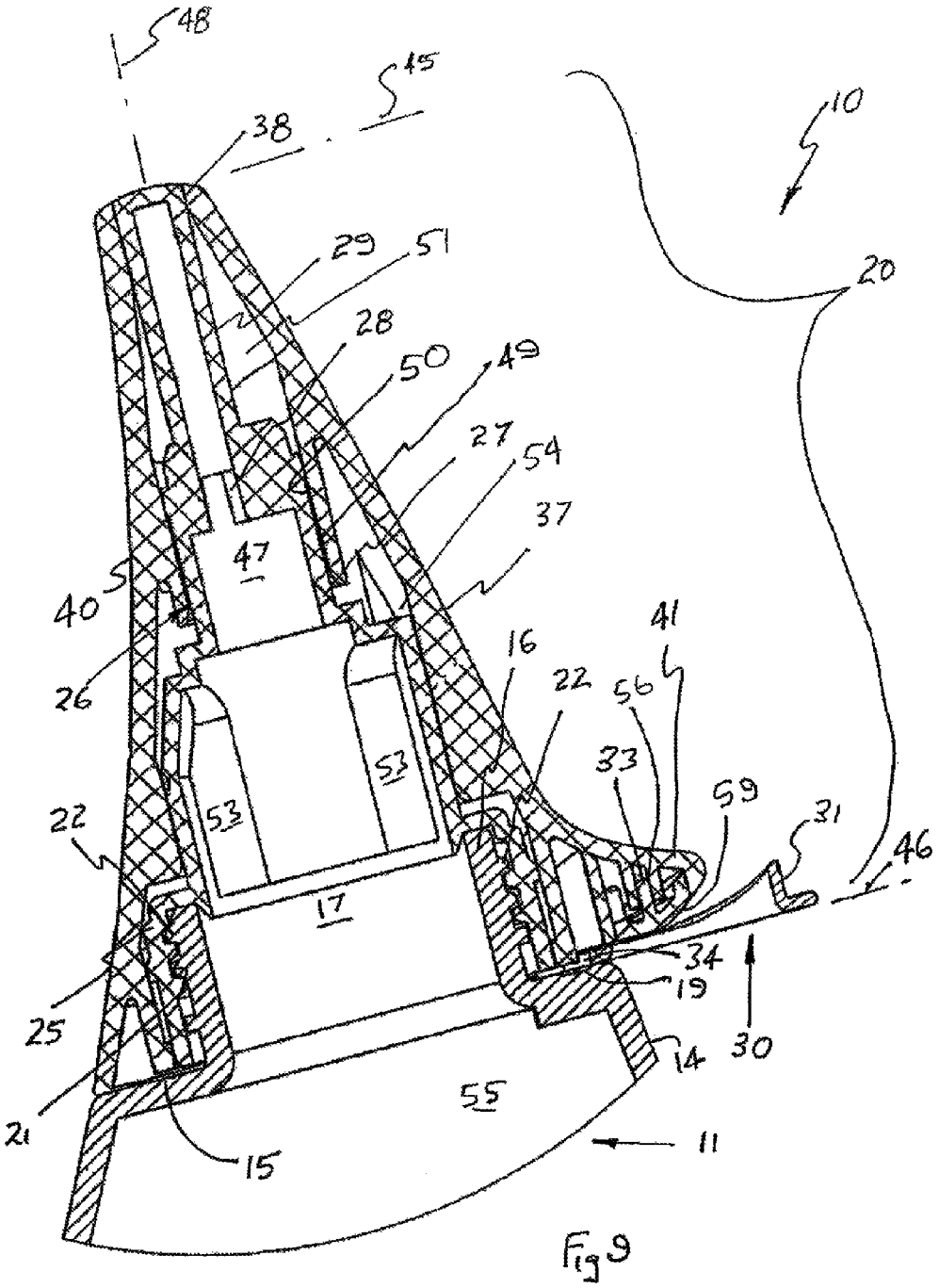
FIG. 9 is a schematic sectioned side elevation of the upper portion of the container of FIG. 1.
Figure 10:
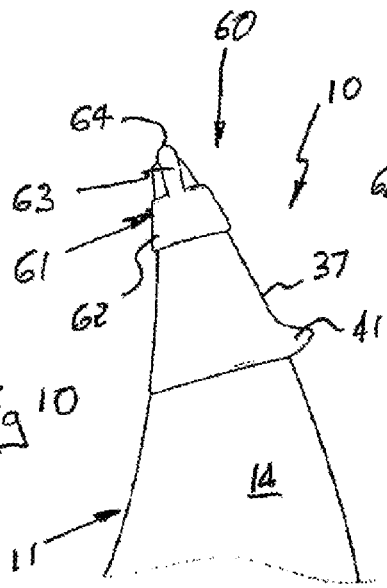
FIG. 10 is a schematic side elevation of a modification of the container of FIGS. 1 to 9.
Figure 11:
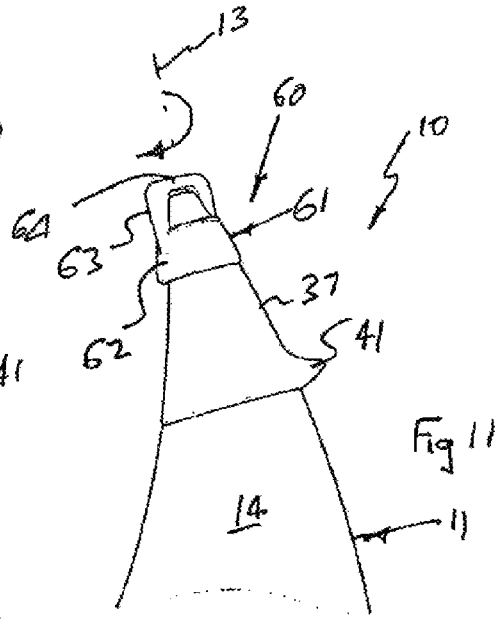
FIG. 11 is a further schematic side elevation of the container of FIG. 10.
Figure 12:
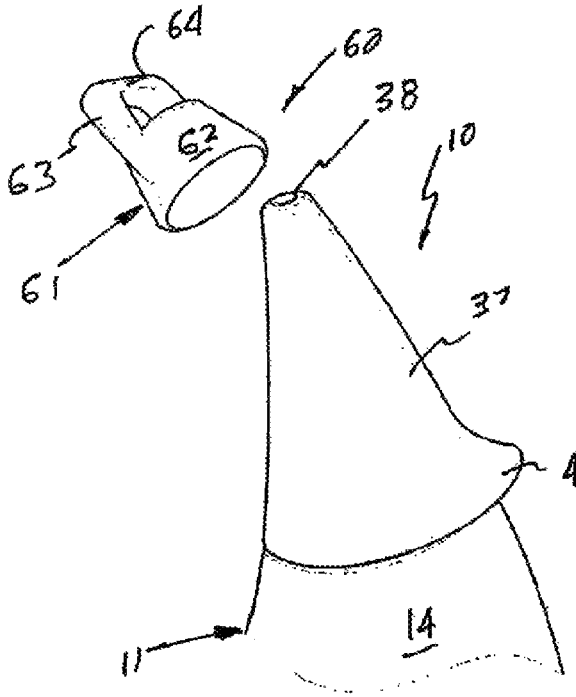
FIG. 12 is a schematic isometric view of the container of FIGS. 10 and 11.
Figure 13:
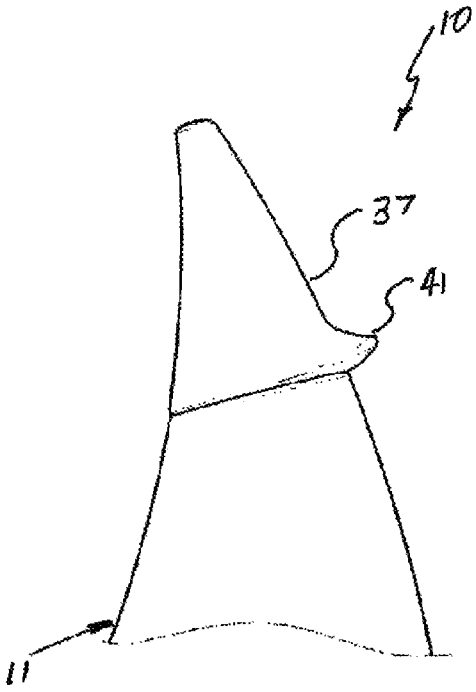
FIG. 13 is a schematic side elevation of the container of FIG. 10 in the claimed configuration.
Figure 14:
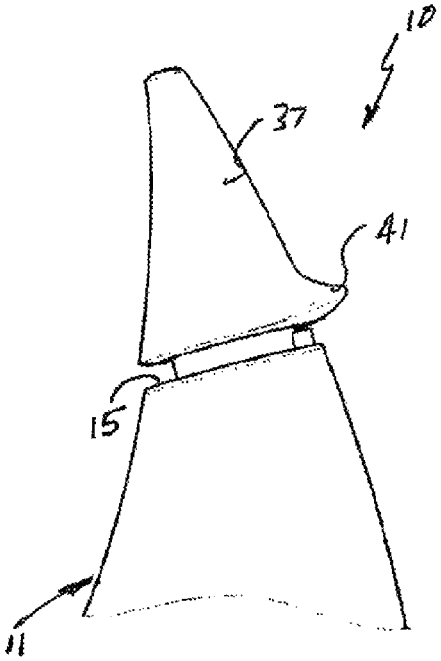
FIG. 14 is a schematic site elevation of the container of FIG. 13 in the open configuration.
Figure 15:
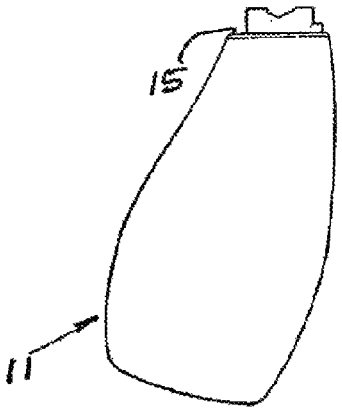
FIG. 15 is a schematic side elevation of the container body employed in the container of FIGS. 10 to 14.
Figure 16:
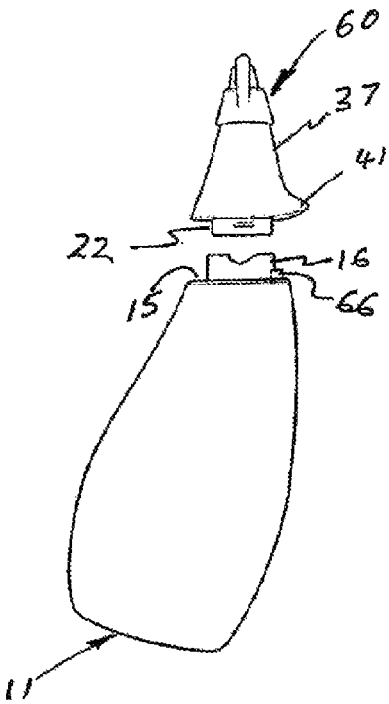
FIG. 16 is a schematic parts exploded side elevation of the container of FIGS. 10 to 12.
Figure 17:
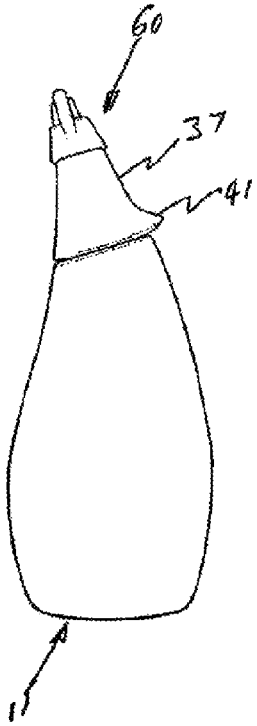
FIG. 17 is a further schematic side elevation of the container of FIGS. 10 to 12.
Figure 18:
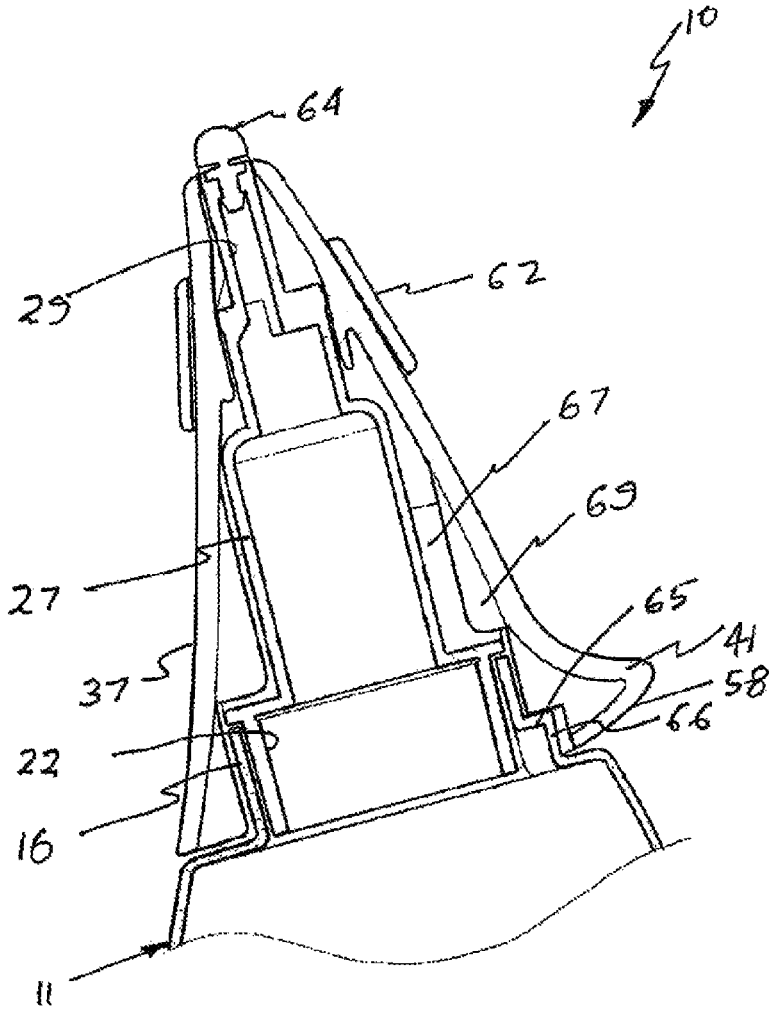
FIG. 18 is a schematic sectioned side elevation of the upper portion of the container of FIGS. 10 to 14.
Figure 19:
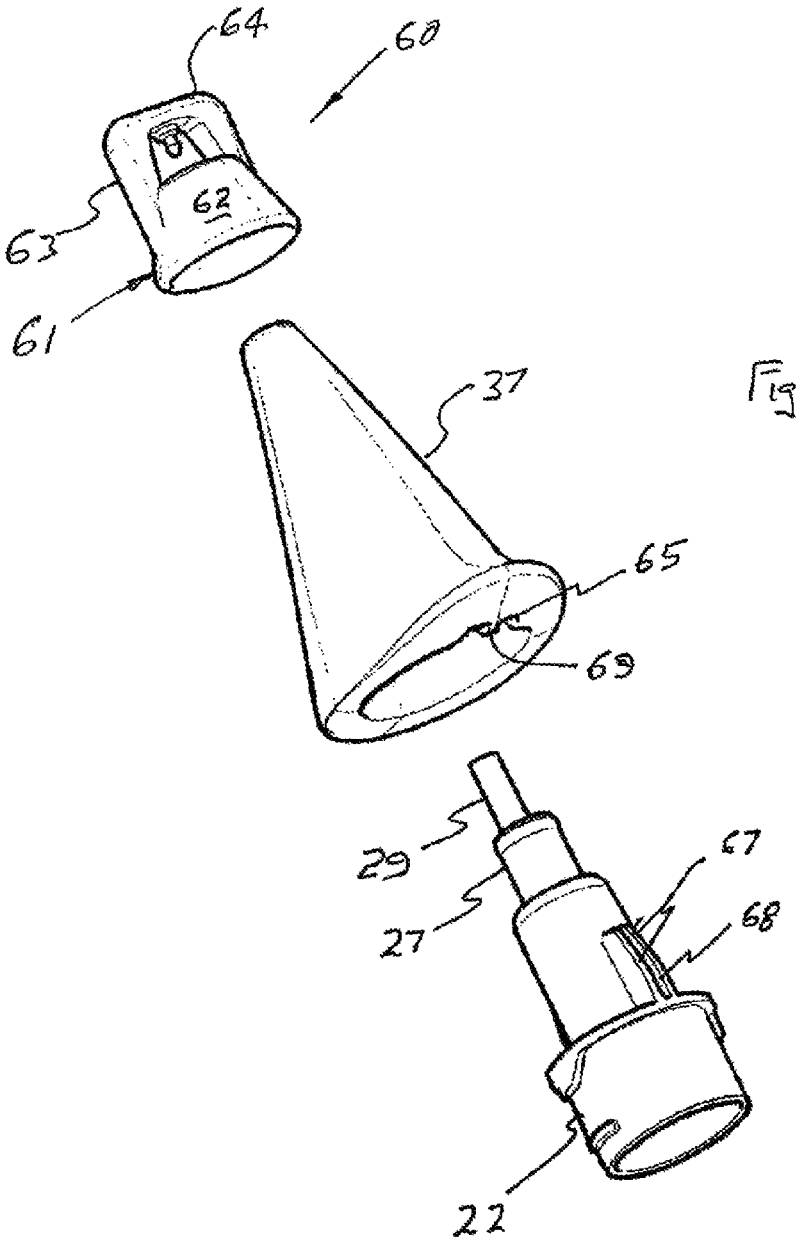
FIG. 19 is a schematic parts exploded isometric view of the portion of FIG. 17.
Figure 20:
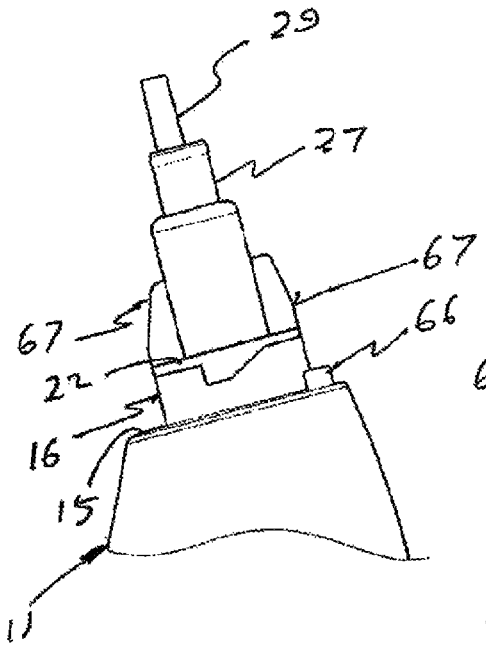
FIG. 20 is a schematic side elevation of the nozzle of the container of FIGS. 10 to 12.
Figure 21:
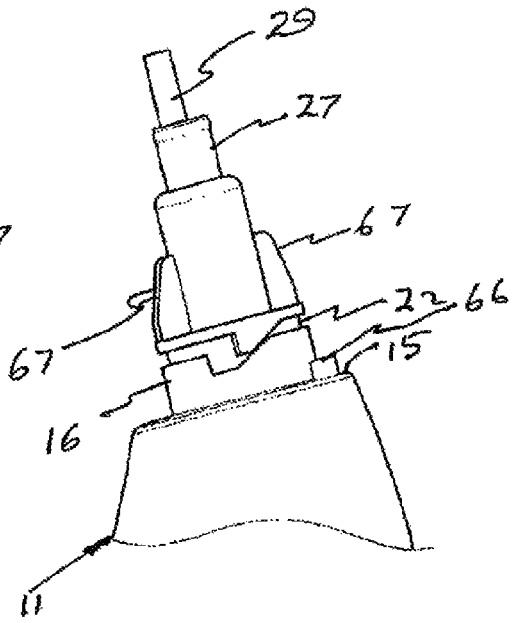
FIG. 21 is a schematic further side elevation of the nozzle of FIG. 20.
Figures 22, 23, 24, 25, 26:
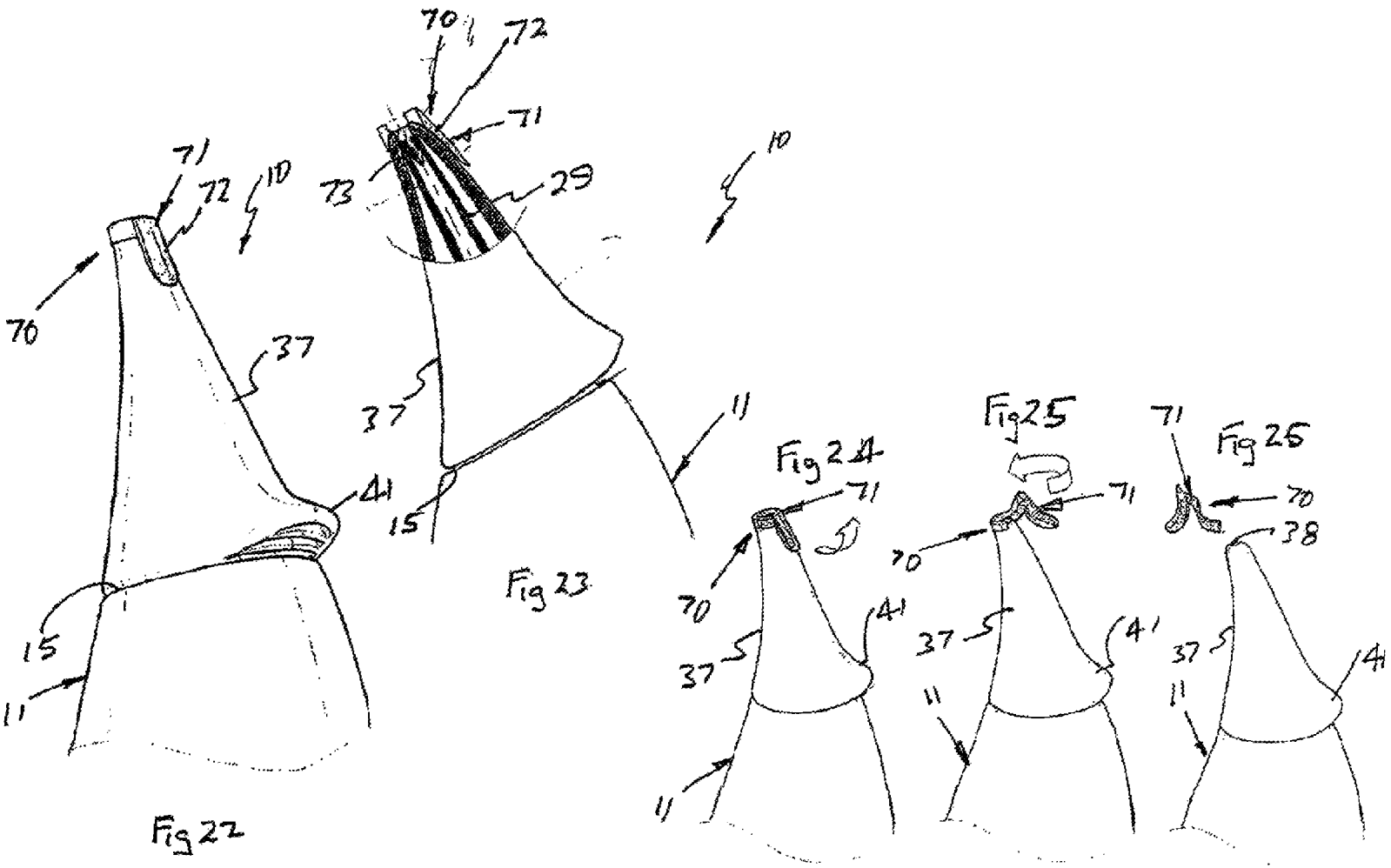
FIG. 22 is a schematic isometric view of a modification of the container of FIG. 1.
FIG. 23 is a schematic parts sectioned side elevation of the container of FIG. 22.
FIG. 24 is a schematic isometric view of the container of FIG. 22.
FIG. 25 is a isometric view of the container of FIG. 22.
FIG. 26 is a isometric view of the container of FIG. 22.
Figures 27, 28, 29, 30:
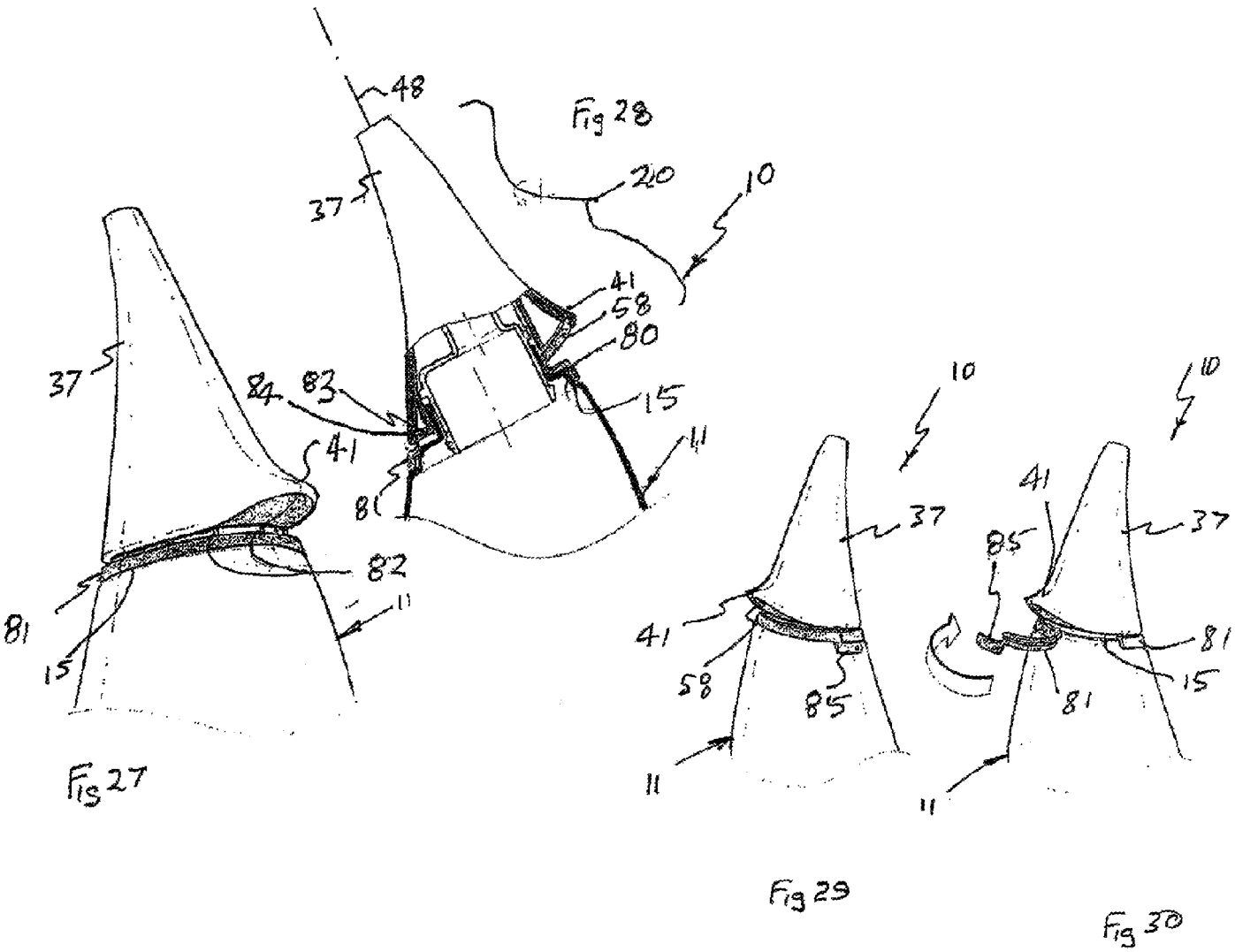
FIG. 27 is a schematic isometric view of a modification of the container of FIG. 1.
FIG. 28 is a schematic parts sectioned side elevation of the container of FIG. 27.
FIG. 29 is a schematic side elevation of a container of FIG. 27.
FIG. 30 is a further side elevation of the container of FIG. 27.
Figures 31, 32, 33, 34:
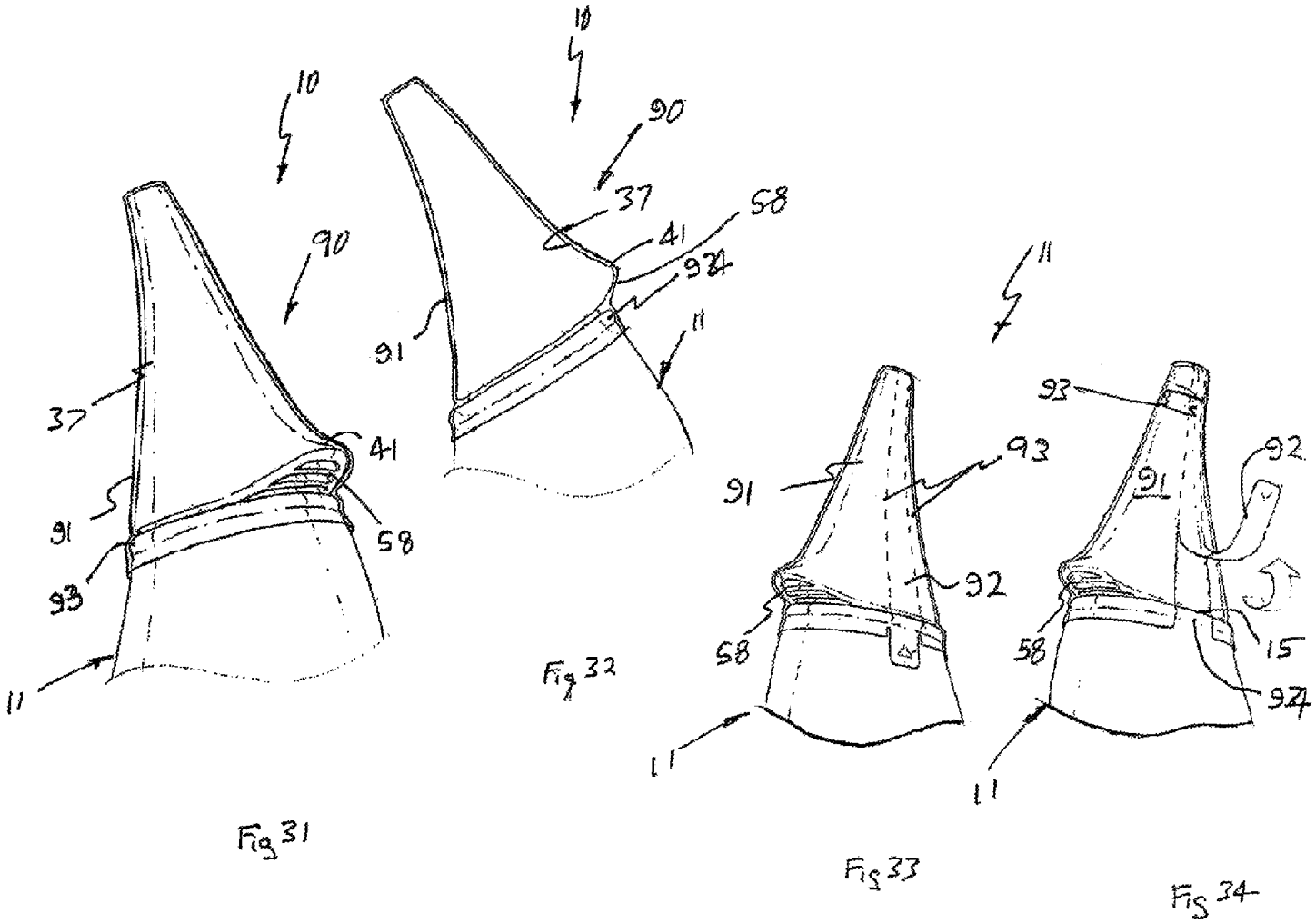
FIG. 31 is a schematic isometric view of a modification of the container of FIG. 1.
FIG. 32 is a schematic side elevation of the container of FIG. 31.
FIG. 33 is a schematic isometric view of the container of FIG. 31.
FIG. 34 is a schematic isometric view of the container of FIG. 31.
Figures 35, 36, 37, 38:
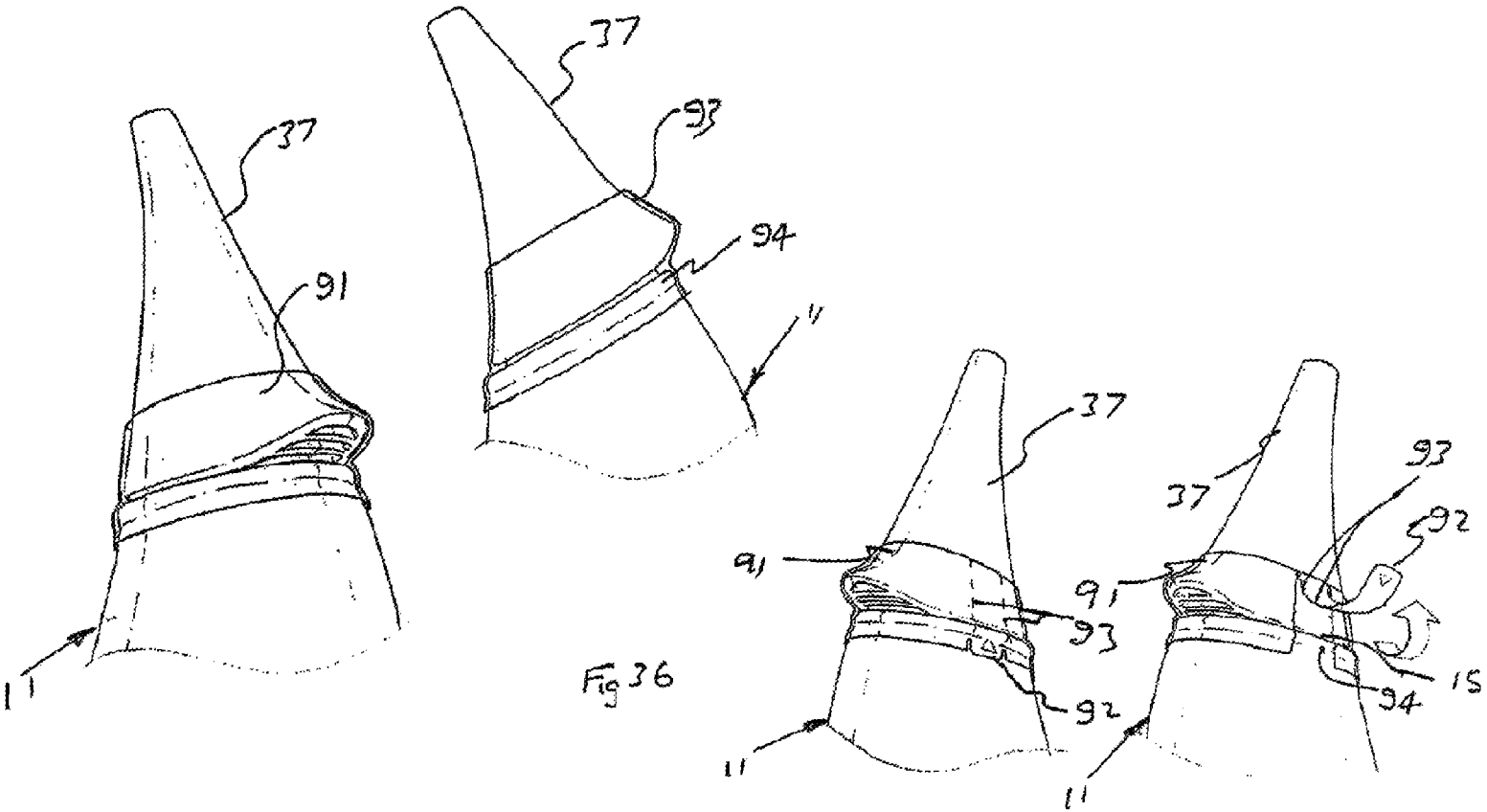
FIG. 35 is a schematic isometric view of a modification of the container of FIG. 1.
FIG. 36 is a schematic side elevation of a container of FIG. 35.
FIG. 37 is a schematic isometric view of the container of FIG. 35.
FIG. 38 is a isometric view of the container of FIG. 35.
Figures 39, 40, 41, 42, 43:
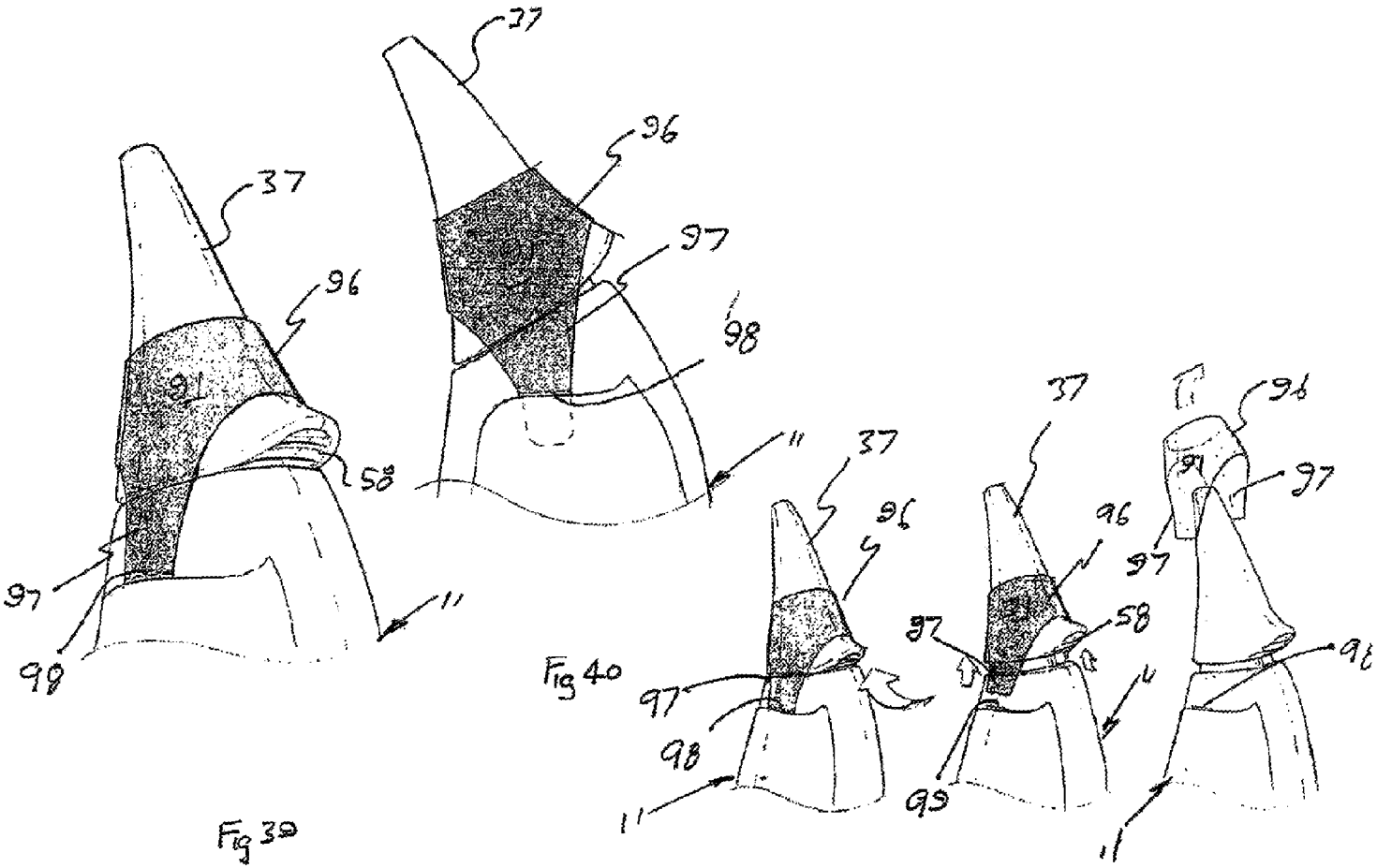
FIG. 39 is a schematic isometric view of a modification of the container of FIG. 1.
FIG. 40 is a schematic side elevation of the container of FIG. 39.
FIG. 41 is a schematic isometric view of the container of FIG. 39.
FIG. 42 is a schematic isometric view of the container of FIG. 39.
FIG. 43 is a parts exploded isometric view of the container of FIG. 39.
Figures 44, 45, 46, 47:
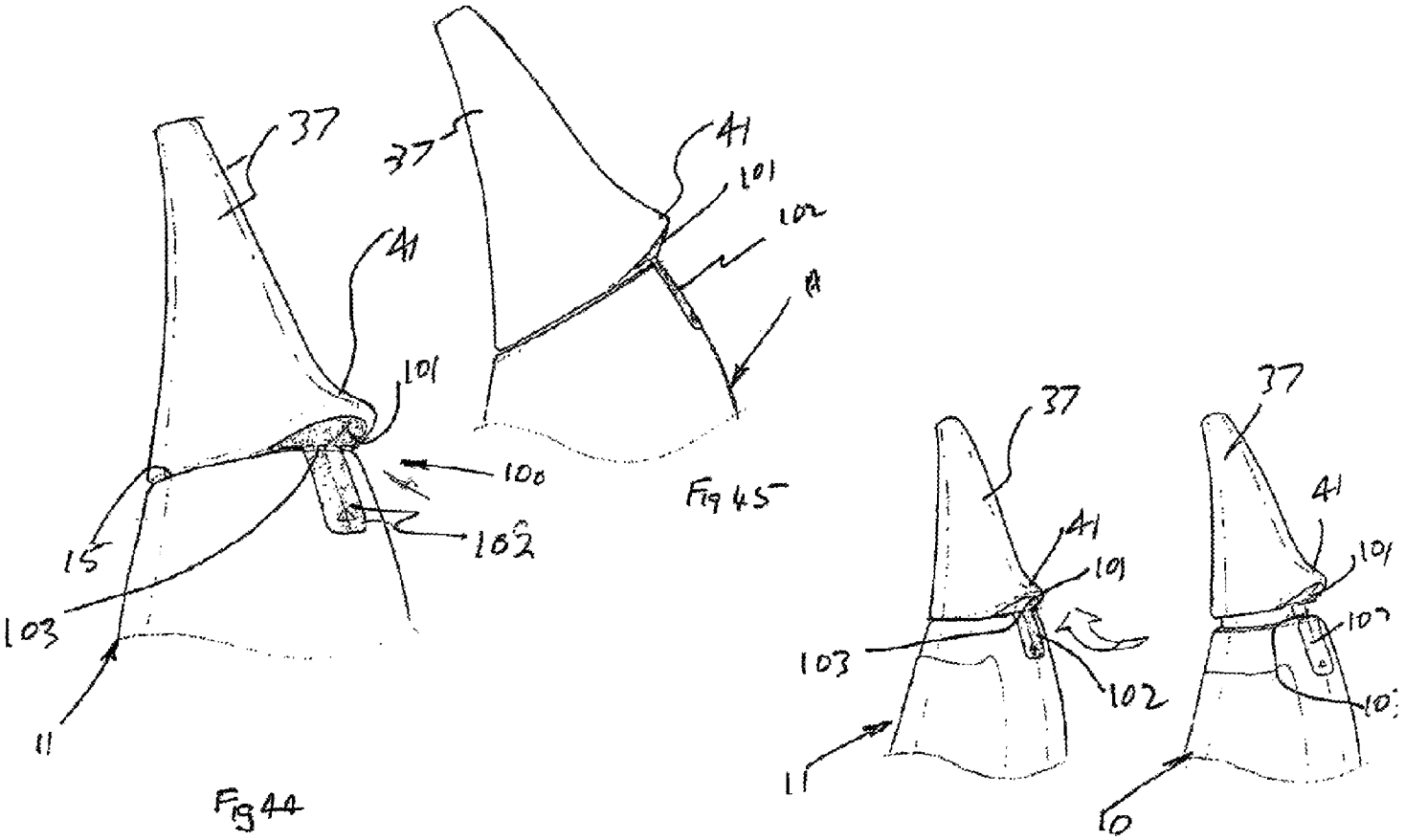
FIG. 44 is a schematic isometric view of a modification of the container of FIG. 32.
FIG. 45 is a schematic side elevation of the container of FIG. 44.
FIG. 46 is a schematic isometric view of the container of FIG. 44.
FIG. 47 is a isometric view of the container of FIG. 44.
Figures 48, 49, 50, 51, 52:
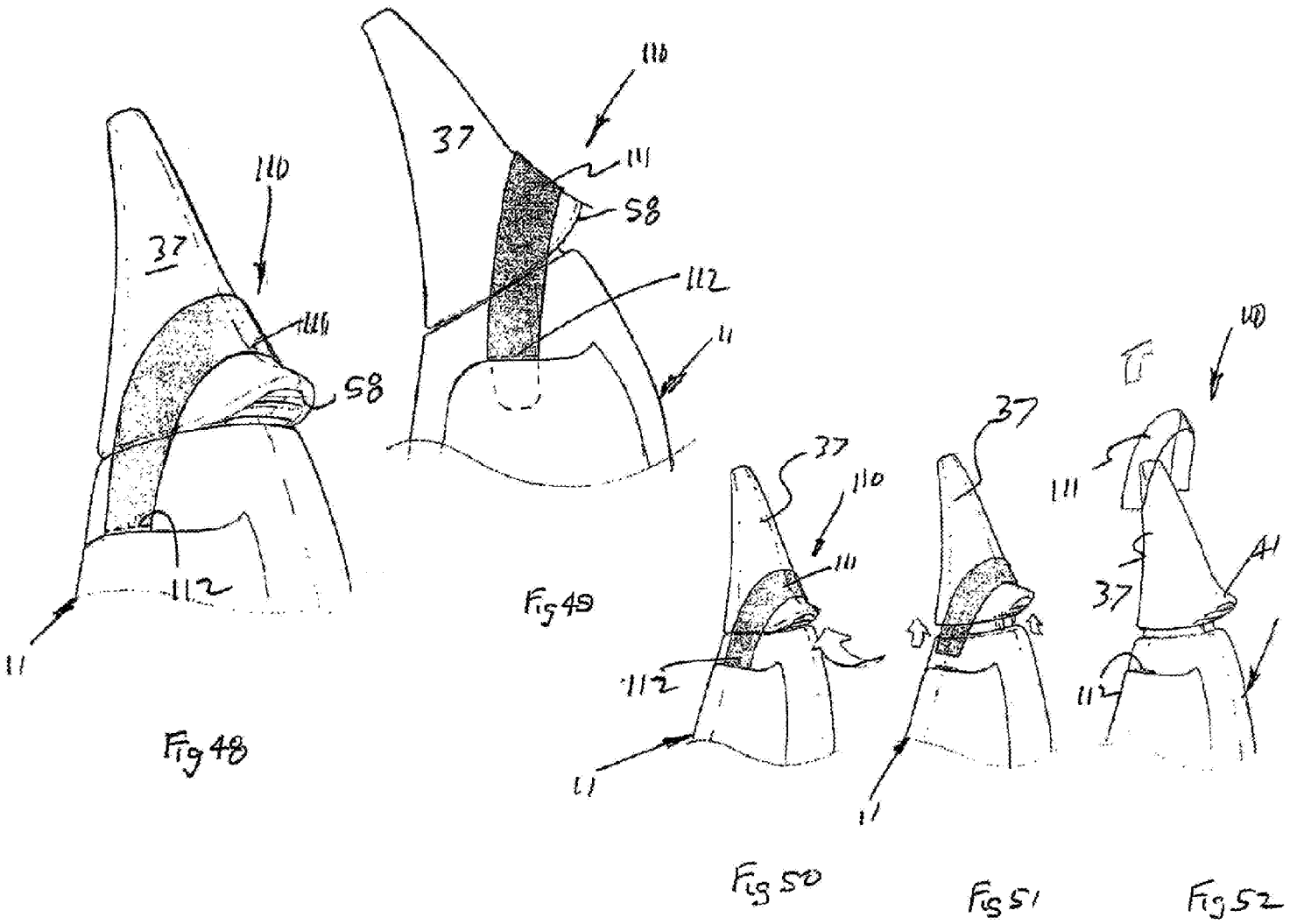
FIG. 48 is a schematic isometric view of a still further modification of the container of FIG. 1.
FIG. 49 is a schematic side elevation of the container of FIG. 48.
FIG. 50 is a schematic isometric view of the container of FIG. 48.
FIG. 51 is a schematic isometric view of the container of FIG. 48.
FIG. 52 is a schematic parts exploded isometric view of the container of FIG. 48.

Mounted on the nozzle member 23 is an outer cap 37. The outer cap 37 terminates with an end opening 38 through which the liquid can be dispensed from the passage 47. However the cap 37 is movable relative to the base member 23 along a generally linear path 48 between a first position located adjacent the shoulder 15, and a second position spaced from the shoulder 15. In the first position of the cap 37, the upper end extremity of the projection 29 closes the opening 38 (as seen in FIG. 9). When the cap 37 is moved to the second position (spaced from the shoulder 15) the projection 29 is spaced from the opening 38 to provide for flow of the liquid from the interior 55 via the passage in the item 27 to exit via the opening 38. The path 48 is inclined by an acute angle to the base 12.

The opening 38 is located in a plane 45 that is inclined to the base 12 by an acute angle. Preferably, the angle is 5' to 20°, most preferably about 10°. Preferably, the shoulder 15 lies in a plane 46 that is generally parallel to the plane 45, and generally perpendicular to the path 48. The path 48 is also the central longitudinal axis of the assembly 20.

To secure the clips 33 to the cap 37, the flange 41 is provided with a plurality of sockets 56 that snap engage or press fit a respective one of the projections 33.

Preferably the path 48 is generally perpendicular to the plane 45. In a further preferred form, the path 48 is perpendicular to the plane 46.

In a further preferred form, the path 48 is linear and inclined by an acute angle to the base 12. Preferably the angle is 70° to 85°, most preferably about 80°.

Preferably the path 48 is perpendicular to the shoulder 15, and the shoulder 15 inclined to the base 12 by an acute angle. Preferably the angle is 5' to 20°, most preferably about 10'.

Preferably the cap 37 has an internal cylindrical surface 49 that slidably and sealingly engages a cylindrical surface 50 of the nozzle member 23, preferably the stem 27. This sliding contact also aids in retaining the liquid in a chamber 51 between the nozzle member 23 and the internal upper surface of the cap 37.

As best seen in FIG. 9, the nozzle member 23, particularly the stem 27, has one or more projections 52 with guide surfaces 50 that slidably engage one or more guide surfaces 54 of the cap 37 to direct the cap 37 to move linearly along the path 48 relative to the nozzle member 23. Accordingly the surfaces 53 and 54 are generally planar and extend longitudinally parallel to the path 48.

In operation of the above described container 10, when the body 11 is filled with a liquid (such as sauce or mayonnaise) the closure assembly 20 is secured to the body 11 by threaded engagement of the threads 18 and 22. Through angular movement (rotation) of the assembly 20 relative to the body 11 about the axis 13, the pawl 34 is allowed to resiliently deflect and move in and out of the recess 19. In particular the relative angular movement is in the direction 39. Once correctly installed, angular movement of the assembly 20 in a direction opposite the direction 39 is prevented by engagement of a surface of the pawl 34 against an end wall (surface) of the recess 19. For example if pressure is put upon the assembly 20 to remove the assembly 20, the webs 35 will fracture thereby removing the indicator 30 from the assembly 20. This then indicates that the container 10 may have been tampered with.

If an attempt is made to move the cap 37 to the second position, that is opening the end opening 28, then engagement of the clips 33 with the cap 37 will cause fracture of the webs 36 and removal of the indicator portion 32. This again will indicate that the container 10 may have been tampered with.

Preferably, the indicator 30 is integrally formed with the nozzle member 23.

The cap 37 has an outer surface 40, with the majority of the surface 40 being continuous (tangential) to the surface 14. However portion of the surface 40 diverts from the surface 14 so as to provide a flange 41. The flange 41 projects beyond the surface 14, at the convex side portion 42, and is of a size that a user may place the body 11 in the palm of their hand to grip the container 10, and use a finger or thumb of that hand to apply pressure to an abutment surface 59 to move the cap 37 between the first position and the second position thereof The abutment surface may be provided by the flange 41 or the part 32.

In FIGS. 10 to 21 of the accompanying drawings there is schematically depicted a modification of the container 10 of FIGS. 1 to 9. The indicator 30 of the previous embodiment is replaced with a tamper indicator 60. The indicator 60 is provided by an indicator portion 61. The indicator portion 61 includes an annular skirt 62 that encompasses a portion of the cap 37. In particular the cap 37 projects longitudinally through the skirt 62, integrally formed with projecting from the skirt 62 is a grippable portion in the form of a handle 63. A transverse portion 64 of the handle 63 is attached to or is formed integral with the end extremity of the projection 29. The indicator portion 61 is detached from the upper extremity of the projection 29 by angular movement of the indicator portion 61 about the axis 13. If the cap 37 is moved away from the shoulder 15, the indicator portion 61 becomes detached thereby indicating that the container 10 has been tampered with. In that regard it should be appreciated the closure assembly 20 includes a recess 65 in the cap 37 that engages over a projection 66 on the shoulder 15 to prevent rotation of the closure assembly 20 to disengage the closer assembly 20 with respect to the body 11. Accordingly the indicator portion 61 provides an indication in respect of whether the closure assembly 20 has been tampered with and whether the cap 37 has been tampered with.

In this embodiment the closure assembly 20 is secured to the body 11 by the lip 16 being internally threaded and engaging an external thread on an annular flange 22. Accordingly in this embodiment the annular flange 22 projects internally of the lip 16. During installation of the assembly 20 on the body 11, engagement of the flange 22 with the lip 16 resiliently deforms the cap 37 so that the recess 65 can engage over the projection 66.

The stem 27 is provided with a pair of elongated flanges 67 that are separated by a slot 68. The cap 37 has an elongated flange 69 that is received in the slot 68 to guide the cap 37 in its linear movement along the path 48. The flanges 67 and 69 have cooperating guide surfaces that ensure the cap 37 moves along the path 48.

It should be appreciated that once the tamper indicator 60 has been removed, the cap 37 may be moved to the dispensing position, and the assembly 20 then removed from the body 11. When the cap 37 is moved to the dispensing position the projection 66 is removed from within the recess 65 so that the assembly 20 may be rotated to disengage the flange 22 from the lip 16.

In one preferred form the indicator portion 61 is attached to the upper extremity of the projection 29 by means of a barb that enters and is secured within a recess in the upper end extremity of the projection 29.

In the embodiment of FIGS. 22 to 26, the indicator 30 is replaced with an indicator 70. The indicator 70 is similar to the indicator portion 61 of the previous embodiment, however in this embodiment the indicator portion 71 is provided a tag portion 72 from which there is extends a barb 73. The barb 73 projects internally of the projection 29 so as to be secured thereto. Should the cap 37 be moved from a position adjacent the shoulder 15, then the tag, portion 72 becomes detached from the projection 29 indicating tampering. A user may remove the indicator portion 71 by gripping the tag portion 72 and causing it to rupture and separate from the barb 73.

In the embodiment of FIGS. 27 to 30, the container 10 has the shoulder 15 formed with an annular bead 80. Snap engaged over the bead 80 is a ring 81 that is attached to the cap 37 by webs (bridges) 82 that are fractured should the cap 37 be moved away from the shoulder 15. Accordingly if the ring 81 becomes detached from the cap 37, then tampering is indicated.

In this embodiment, movement of the cap 37 will occur if an attempt is made to move the closure assembly 20 from the body 11.

The closure assembly 20 includes a securing ring 83 that is integrally formed with the ring 81 and webs 82, with the ring 83 fixed to the cap 37 by being secured in an annular recess 84 thereof.

The cap 37 may be removed along the path 48 as discussed with reference to the first embodiment, by gripping a tag 85, which is part of the ring 81, and moving the tag 85 angularly about the axis 13. This causes fracturing of the webs 82 and separates the ring 81 from the ring 83. The cap 37 may then be moved.

In the embodiment of FIGS. 31 to 34, the tamper indicator 30 is replaced with the tamper indicator 90. The tamper indicator 90 is formed of a sheet material (such as plastics material) 91 that would be typically "heat shrunk" over the cap 37 and the upper portion of the body 11 so as to secure the cap 37 to the body 11 in a position adjacent the shoulder 15. However adjacent the shoulder 15 a bead 94 would be formed that would retain the indicator 90 fixed to the body 11. A tear strip 92 having an end portion to be gripped, provides for removal of the indicator 90. The sheet material 91 has perforation lines 93 that provide for deformation of the sheet material 91 and its removal. As can be appreciated, deforming the indicator 90 including tearing of the tear strip 92 indicates that the container 10 has been tampered with.

It should also be appreciated the assembly 20 cannot be removed until the tear strip 92 has been operated and the sheet material 91 removed.

In the embodiment of FIGS. 35 to 38, the sheet material 91 only encompasses a lower portion of the cap 37.

In the embodiment of FIGS. 39 to 43, the sheet material 91 encompasses a portion of the cap 37 by including a socket portion 96 from which there extends an elongated portion 97 that is attached to the body 11.

Fracturing of the elongated portion 97 along the perforations 98 provides for removal of the portion 97 therefore enabling movement of the cap 37.

In the embodiment of FIGS. 44 to 47, the indicator 30 is replaced with an indicator 100. The indicator 100 includes a base 101 that is fixed in a cavity provided by the flange 41. Extending from the base 101 is a tag 102, with a portion of the tag 102 being fixed to the body 11. As the base 101 is fixed to the cap 37 should the cap 37 be dislodged from the position adjacent the shoulder 15, the tag 102 is ruptured along the perforations 103. Rupturing of the perforations 103 would indicate that the container 10 had been tampered with.

In the embodiment of FIGS. 48 to 51, the indicator 30 is replaced with an indicator 110. The indicator 110 is an indicator strip 111 that goes over portion of the cap 37 and is secured to the body 11. A line of perforations 112 provides for separation of the cap 37 from the body 11. However rupturing of the perforations 112 would indicate that the container 10 had been tampered with.

Figure 53:
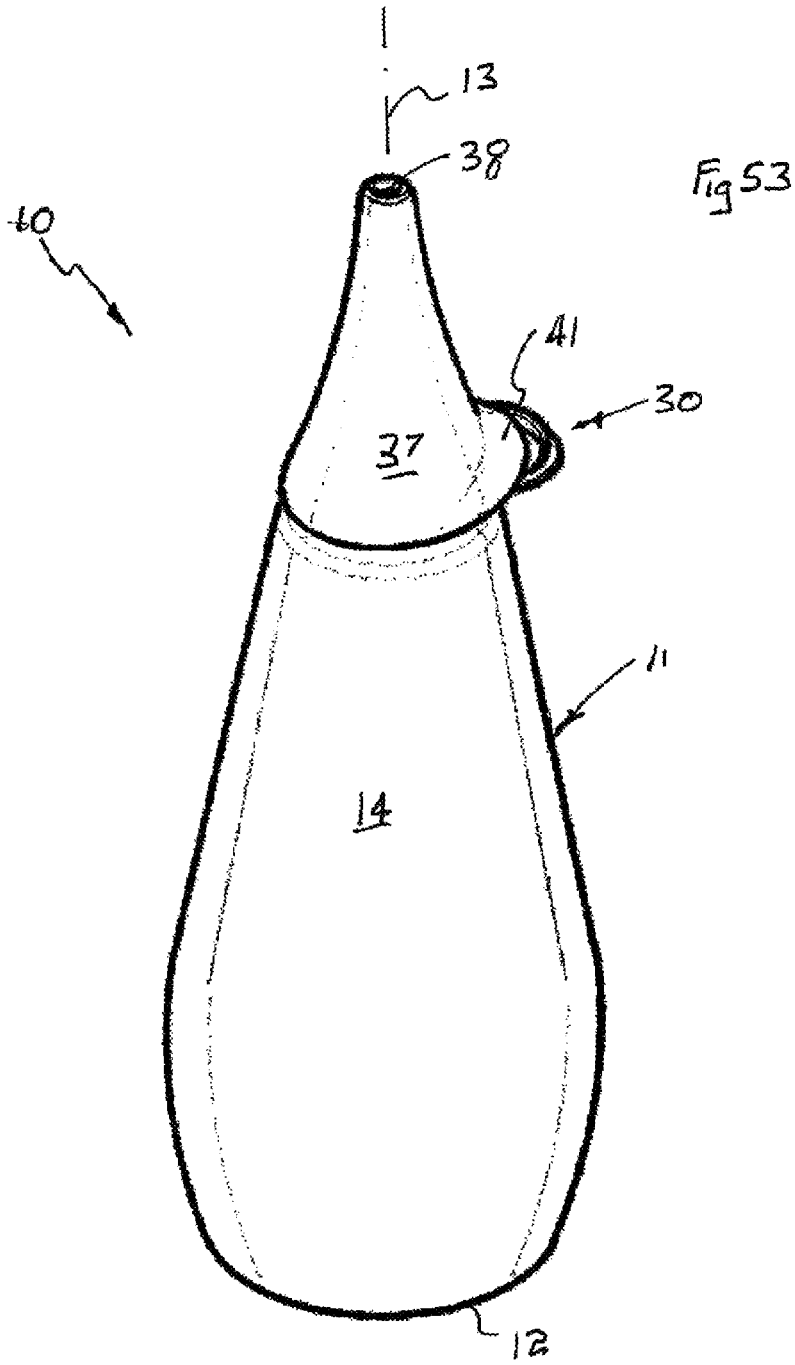
FIG. 53 is a schematic isometric view of a modification of the container of FIGS. 1 to 9.
Figure 54:
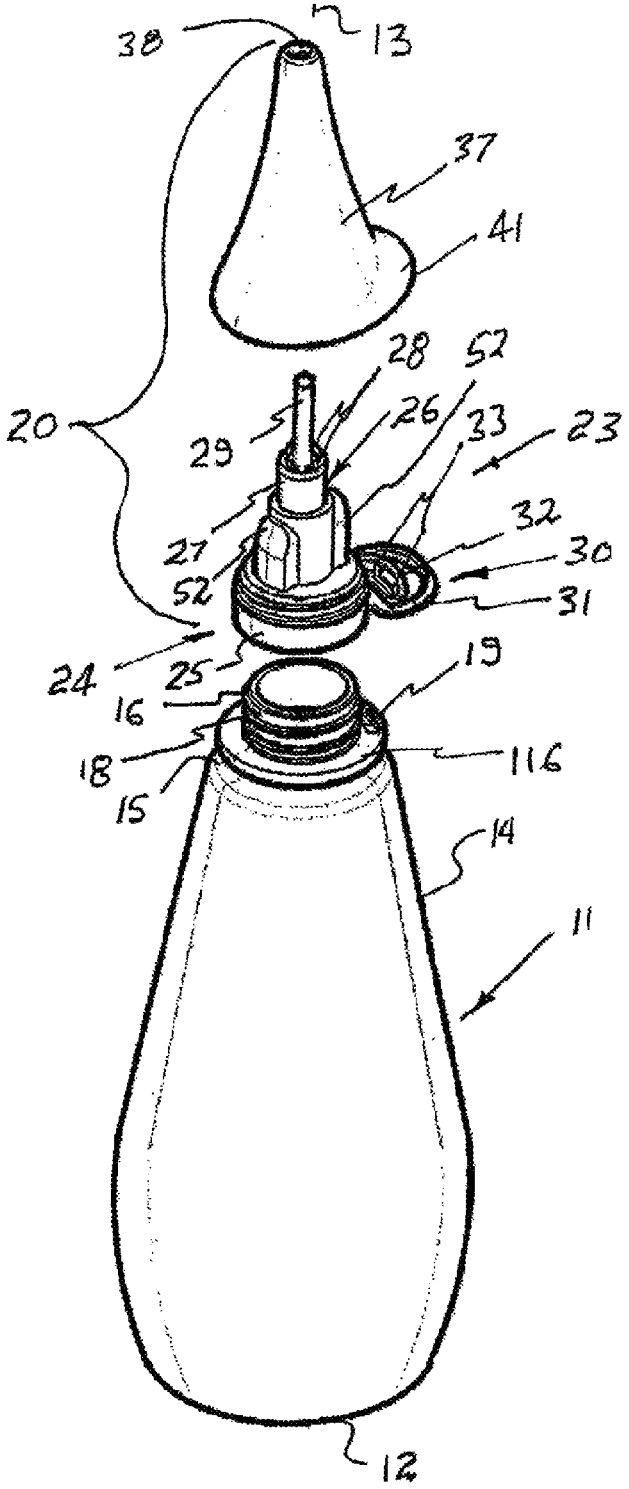
FIG. 54 is a schematic parts exploded isometric view of the container of FIG. 53.
Figure 55:
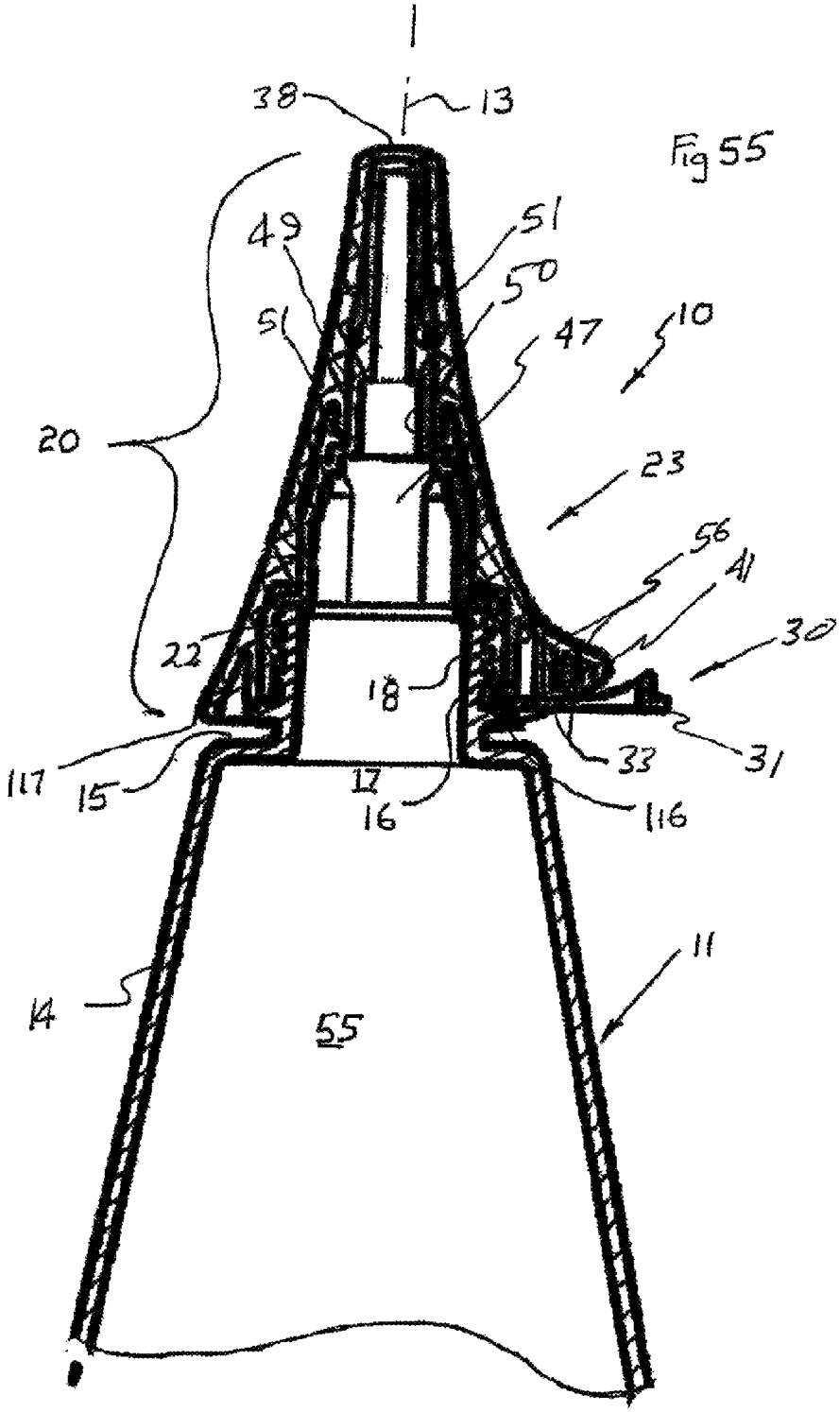
FIG. 55 is a schematic section side elevation of an upper portion of the container of FIG. 53.

A modification of the container 10 of FIGS. 1 to 9 will now be described with reference to FIGS. 53 to 55.

In this embodiment the body 11 is generally circular in transverse cross-section (transverse of the axis 13). However, like the previous embodiment, the body 11 is resiliently deformable so that the body 11 may be squeezed to dispense contents from the interior 55.

In this embodiment the axis 13 is generally perpendicular to the base 12. Accordingly when the base 12 is resting on a generally horizontal surface, the axis 13 is generally vertical.

The cap 37 is moved along a generally linear path defined by the axis 13. Accordingly the cap 37 moves along a path generally perpendicular to the base 12.

Figure 8:
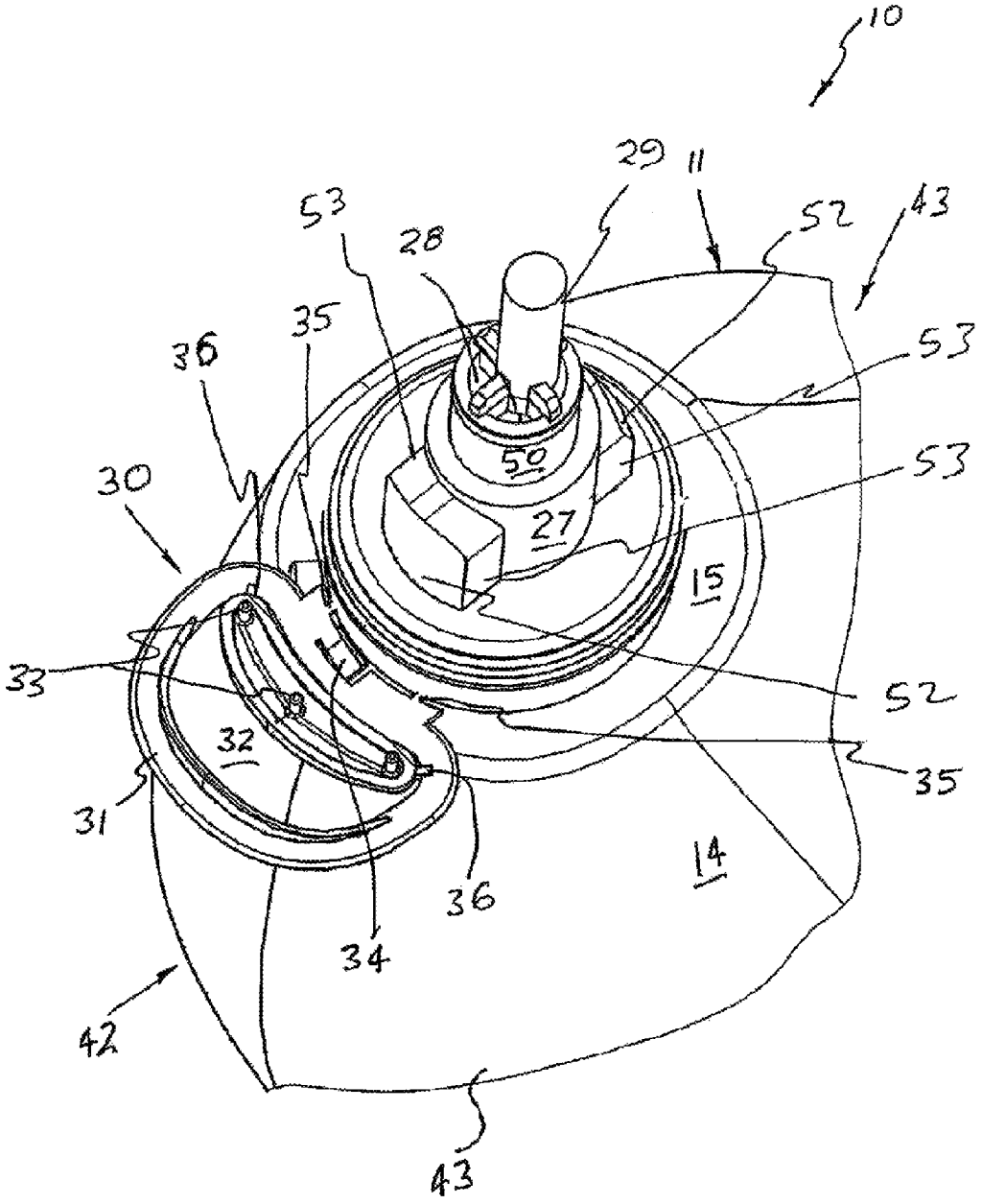
FIG. 8 is a schematic top isometric view of portion of the container of FIG. 1.

The lip (neck) 16 is provided with an angular flange 116 that is provided with the recess 19 that is engaged with the pawl 34 (shown in FIG. 8).

The outer cap 37 has a cylindrical flange 117 that engages the annular flange 116 when the cap 37 is in the position at which the opening 38 is closed by the stem 29. Preferably the flange 116 extends rotatably relative to the axis 13. The flange 116 is spaced from the shoulder 15 along the axis 13.

The above described preferred embodiments have a number of advantages including having a tamper indicator for indicating whether the closer assembly 20 has been tampered with and/or the cap 37 has been tampered with. For example if the cap 37 is moved and/or the flange 22 moved relative to the lip 16, the displacement can be detected.

A further advantage of the above described preferred embodiments is that the tamper indicator is visible without removing the closure assembly.

Another advantage of the above described preferred embodiments is that the container 10 can be operated with a single hand. The body 11 is placed in the palm of the hand and the thumb used to apply pressure to the flange 41 to move the flange 41, and therefore the cap 37, between the first and second positions thereof.

The above described preferred embodiments also have the advantage of being easy to grip and operate as the peripheral surface 14 tapers towards the closure assembly 20. Also the major surfaces 43 and 44, by being slightly curved or most likely generally planar, are easily resiliently deformed to apply pressure to the contents of the interior 55.

A still further advantage of the above described preferred embodiments is that the nozzle is inclined by an acute angle to the base, thereby reducing the angle through which the container is to be pivoted in order to dispense the liquid in a desired direction.

What is claimed is:

1. A container from which a liquid can be dispensed, the container including:

a hollow body having a interior to receive the liquid, and a lip surrounding a body opening via which the liquid can leave said interior;

a closure assembly attached to the body to close said opening, said assembly including:

a member including a base attached to the body adjacent said lip, a passage extending through the member and being in communication with said interior to provide for the dispensing of said liquid from said interior via said passage;

a cap having a cap end opening via which the liquid is dispensed, said opening communicating with the said passage, said cap being mounted on the member for movement relative thereto between a first position at which the member closes said cap opening and a second position allowing the flow of liquid from within the passage to exit via said cap opening; and a tamper indicator that, when the closure assembly is attached to the body, provides a visual indication in respect of whether the base has been moved relative to the body thereby providing an indication in respect of whether the interior has been exposed, and a visual indication in respect of whether said cap has been moved from the first position exposing said passage.

2. The container of claim 1, wherein said member is a nozzle member, with the nozzle member including a nozzle extending from the base and through which the passage also extends, with the nozzle cooperating with the cap to open and close the cap end opening.

3. The container of claim 1, wherein the base threadably engages the lip to secure the base and therefore closure assembly to the body, and the cap engages the member so as to be restrained to move along a generally linear path between the first and second positions of the cap.

4. The container of claim 1, wherein the tamper indicator includes a tamper indicator portion that extends between the cap and the body and that is ruptured should the closure assembly be moved relative to the body or the cap moved relative to the member.

5. The container according to claim 1, wherein said body has a body base upon which the body rests so that the body extends generally upwardly therefrom, with the closer assembly having a longitudinal axis along which the cap moves between the first and second positions thereof.

6. The container of claim 5, wherein the longitudinal axis is generally perpendicular to the body base.

7. The container of claim 5, wherein the longitudinal axis is inclined to the body base by an acute angle.

8. The container according to claim 1, wherein the tamper indicator includes a first indicator portion indicating whether the base has been moved relative to the body, and a second indicator portion indicating whether the cap has been moved relative to the base.

9. The container of claim 8, wherein the first indicator portion includes bridges or webs that are fractured to indicate tampering, and said indicator includes a handle gripped by a user to remove the indicator.

10. The container of claim 8 or 9, wherein the second indicator portion includes webs or bridges that are fractured to indicate tampering, with the indicator including an indicator part attached to the cap with the second indicator portion attaching the indicator part to the handle.

11. The container of claim 1, wherein the closure assembly and body have cooperating surfaces that engage to at least inhibit movement of the closure assembly to remove the closure assembly from the body.

12. The container of claim 11, wherein the cooperating surfaces are provided by a cooperating abutment and pawl.

* * * * *